US007789642B2

(12) United States Patent
Tsuruoka et al.

(10) Patent No.: US 7,789,642 B2
(45) Date of Patent: Sep. 7, 2010

(54) GEAR PUMP AND METHOD OF PRODUCING THE SAME

(75) Inventors: Katsuma Tsuruoka, Kanagawa (JP); Keigo Kajiyama, Kanagawa (JP); Norihiro Saita, Kanagawa (JP); Takayuki Furuya, Kanagawa (JP); Kenji Hiraku, Ibaraki (JP)

(73) Assignee: Hitachi, Ltd., Tokyo (JP)

( * ) Notice: Subject to any disclaimer, the term of this patent is extended or adjusted under 35 U.S.C. 154(b) by 895 days.

(21) Appl. No.: 11/587,761

(22) PCT Filed: Apr. 28, 2005

(86) PCT No.: PCT/JP2005/008127

§ 371 (c)(1),
(2), (4) Date: Oct. 27, 2006

(87) PCT Pub. No.: WO2005/106252

PCT Pub. Date: Nov. 10, 2005

(65) Prior Publication Data

US 2007/0231169 A1 Oct. 4, 2007

(30) Foreign Application Priority Data

Apr. 30, 2004 (JP) ..... 2004-136476
Apr. 1, 2005 (JP) ..... 2005-106480

(51) Int. Cl.
*F03C 2/00* (2006.01)
*F03C 4/00* (2006.01)
*F04C 2/00* (2006.01)

(52) U.S. Cl. ..... 418/126; 418/132; 418/152; 418/206.1; 418/206.6; 418/206.7

(58) Field of Classification Search ..... 418/126, 418/128, 131, 132, 152, 178, 179, 206.1, 418/206.6–206.9
See application file for complete search history.

(56) References Cited

U.S. PATENT DOCUMENTS 3,847,519 A * 11/1974 Dworak et al. ..... 418/126
3,915,604 A * 10/1975 Kitta et al. ..... 418/126
4,336,005 A * 6/1982 McBurnett et al. ..... 418/126
4,744,738 A * 5/1988 Miki et al. ..... 418/126
5,199,239 A 4/1993 Younger

FOREIGN PATENT DOCUMENTS

GB 2101220 A * 1/1983
JP 2001-123903 A 5/2001
JP 2001-214870 A 8/2001
JP 2002-195147 A 7/2002
JP 2002202070 A * 7/2002

* cited by examiner

*Primary Examiner*—Theresa Trieu
(74) *Attorney, Agent, or Firm*—Foley & Lardner LLP

(57) ABSTRACT

In a gear pump equipped with a pump assembly formed from a driving gear supported by a driving shaft, a driven gear supported by a driven shaft, a pair of side plates disposed at both sides in an axial direction of driving and driven shafts, and a seal block that seals tips of the gears and forms a first fluid chamber by installation onto the side plates, and a casing that houses the pump assembly and forms a second fluid chamber therein, ribs are provided for at least one member of the side plates or the seal block, and fluid tightness between the first and second fluid chambers is secured by exerting pressure between the side plates and seal block and additionally plastically deforming the ribs. By this, it is possible to provide the gear pump which is capable of achieving improvement of the seal integrity while reducing the parts count.

18 Claims, 20 Drawing Sheets

GEAR PUMP AND METHOD OF PRODUCING THE SAME

TECHNICAL FIELD

The present invention relates to a gear pump which is suitable for, for example, an oil pressure source for brake system etc for vehicle, and to method for manufacturing the gear pump.

BACKGROUND ART

As a conventional gear pump, for example, an art described in Patent Publication 1 has been shown. The gear pump described in this publication houses a pump assembly constructed from a driving shaft that supports a driving gear, a driven shaft that supports a driven gear, a pair of side plates, and a seal block, in a body case. On an abutting surface between this side plate and the seal block, a soft seal member is placed, and thereby ensures seal integrity.

Patent Publication 1: Japanese Patent Application Kokai Publication No. 2001-214870

DISCLOSURE OF THE INVENTION

In the above conventional art, however, in order to improve the seal integrity, additional seal members have to be provided. This makes the control of parts complicated due to an increase in the number of parts, and there has been a problem of increase in cost.

The present invention has been made in view of the above conventional problem and aims to provide a gear pump which is capable of achieving improvement of the seal integrity while reducing the parts count.

In order to achieve the above aim, in the present invention, in a gear pump equipped with a pump assembly formed from a driving gear supported by a driving shaft, a driven gear supported by a driven shaft, a pair of side plates disposed at both sides in an axial direction of driving and driven shafts, and a seal block that seals tips of the gears and forms a first fluid chamber by installation onto the side plates, and a casing that houses the pump assembly and forms a second fluid chamber therein, ribs are provided for at least one member of the side plates or the seal block, and fluid tightness between the first and second fluid chambers is secured by exerting pressure between the side plates and seal block and additionally plastically deforming the ribs.

Accordingly, it becomes possible to ensure the seal integrity by the plastic deformation without provision of the additional seal members and the like, and also to reduce the parts count.

DESCRIPTION OF THE PREFERRED EMBODIMENTS

Exemplary embodiments of the present invention will be explained below with reference to the drawings.

An Embodiment 1

Figure 1:
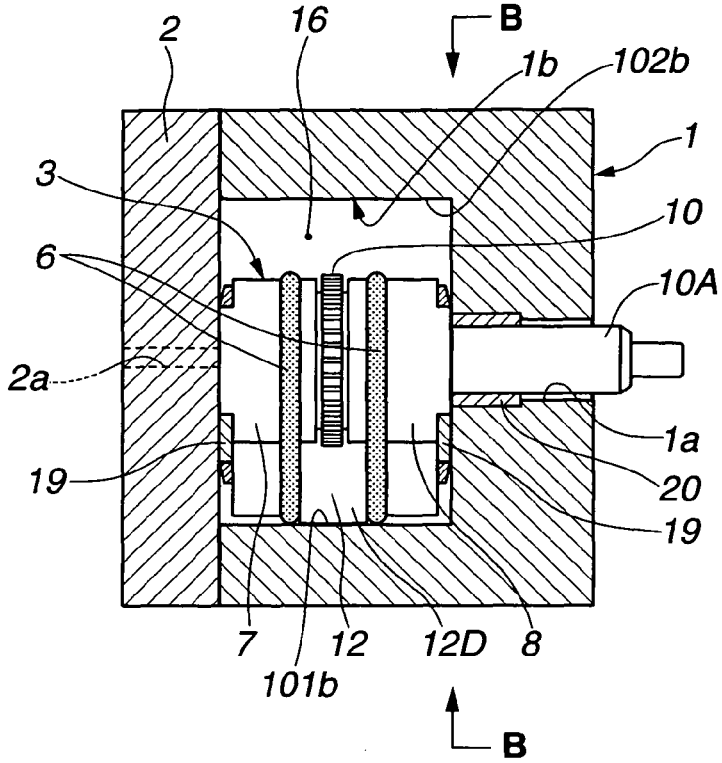
FIG. 1 is a local sectional view taken along the line A-A, showing a gear pump of an embodiment 1.
Figure 2:
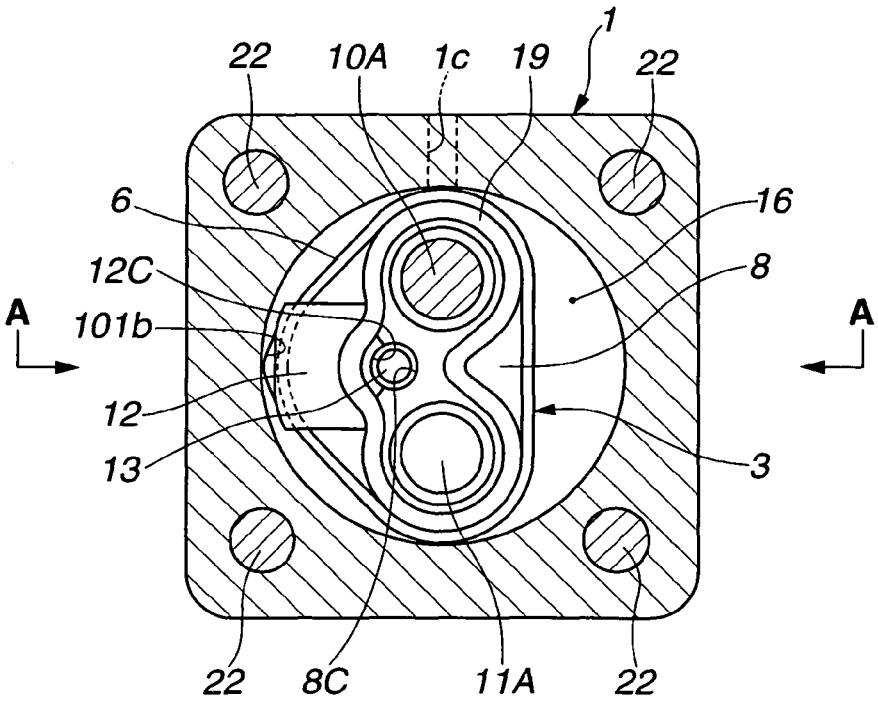
FIG. 2 is a sectional view taken along the line B-B, showing the gear pump of the embodiment 1.
Figure 3:
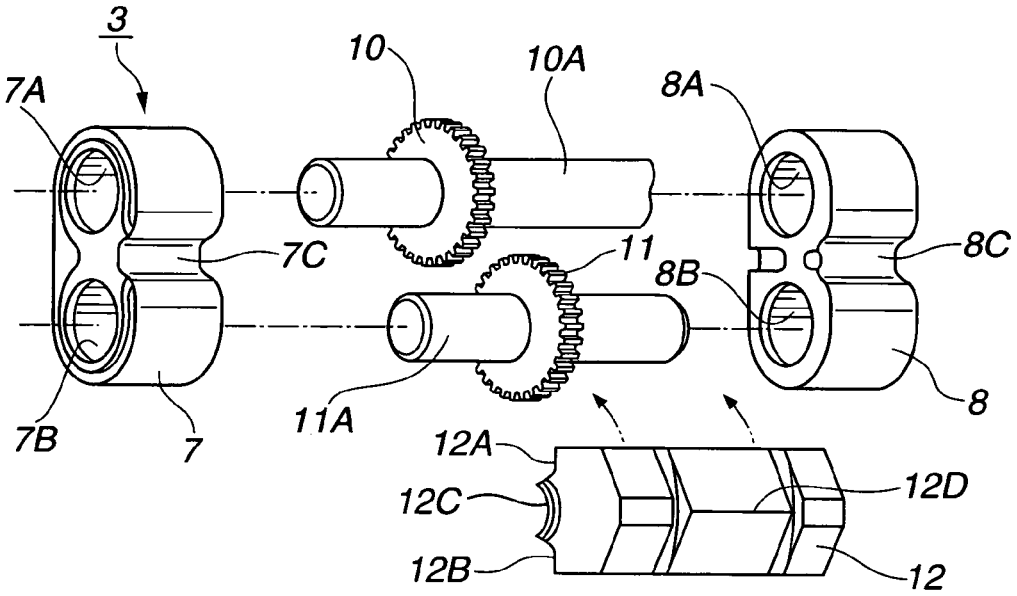
FIG. 3 is an exploded view showing a pump assembly of the embodiment 1.

Firstly, configuration will be explained with reference to FIGS. 1 to 3. FIG. 1 is a sectional view of a gear pump, taken along 15 the line A-A. Here, for explanation, only a casing (a pump housing 1 and a housing cover 2) is shown by sectional view, and a pump assembly 3 installed in the casing is shown by side view. FIG. 2 is a sectional view of the gear pump, taken along the line B-B. FIG. 3 is an exploded view showing pump assembly 3.

(Regarding the Casing)

Pump housing 1 is formed with a cylindrical-shaped cylinder bore 1*b* that houses pump assembly 3. A driving shaft supporting bore 1*a* is formed at a bottom surface portion of this cylinder bore 1*b*. In an inner circumference of driving shaft supporting bore 1*a*, a bearing 20 is provided, and an after-mentioned driving shaft 10A is rotatably supported by driving shaft supporting bore 1*a*.

An inner circumference surface of cylinder bore 1*b* is formed of an abutting surface 101*b* for the positioning, and an inner wall 102*b*. Abutting surface 101*b* is formed with greater precision than inner wall 102*b* to accurately support driving shaft 10A by driving shaft supporting bore 1*a* . A discharge port 1*c* is provided in radial direction of pump housing 1, and it communicates between cylinder bore 1*b* and the outside of pump housing 1.

At the opposite side in axial direction to driving shaft supporting bore 1*a*, a housing cover 2 is installed onto pump housing 1 with bolts 22. By cylinder bore 1*b* and housing cover 2, pump assembly 3 is liquid-tightly housed in cylinder bore 1*b*. An inlet port 2*a* that communicates with an after-mentioned inlet passage 13 is provided in the axial direction for housing cover 2.

(Regarding the Pump Assembly)

As shown in FIG. 3, pump assembly 3 is formed from a driving gear 10 provided for and supported by driving shaft 10A, a driven gear 11 provided for and supported by a driven shaft 11A, a pair of side plates 7, 8 disposed at both sides in the axial direction of driving and driven shafts 10A, 11A, and a seal block 12. Driving shaft 10A is connected with a motor that is not shown.

Side plate 7 formed with supporting holes 7A, 7B and side plate 8 formed with supporting holes 8A, 8B are slid onto driving and driven shafts 10A, 11A from the both sides in the axial direction of driving and driven shafts 10A, 11A. By this setting, driving and driven gears 10, 11 can be rotatably supported while being engaged with each other. In addition, pumping is done without leakage by this engagement. Side plates 7, 8 are made from high hardness materials.

On each side of abutting surfaces of side plates 7, 8, on which seal block 12 abuts, arc-shaped grooved portions 7C and 8C are formed. Grooved portion 7C is formed between supporting holes 7A, 7B, and grooved portion 8C is formed between supporting holes 8A, 8B. These grooved portions 7C and 8C are formed in the axial direction throughout the width of side plates 7, 8. Each seal ring 19 is provided between side plate 7 and housing cover 2, and between side plate 8 and pump housing 1. Seal ring 19 extends through both sides of side plates 7,8 and seal block 12, and is supported by being sandwiched between the casing and side plates 7, 8 and seal block 12. Each seal ring 19 is set so that seal ring 19 liquid-tightly seals portions between side plates 7, 8, seal block 12 and pump housing 1, housing cover 2.

At a side of abutting surfaces of seal block 12, on which side plates 7, 8 abut, recessed curved surfaces 12A, 12B, which are cut into a recessed curved shape along tips of gear of driving and driven gears 10, 11, are formed. Further, an arc-shaped arc groove 12C is formed at a position between recessed curved surfaces 12A, 12B, where grooved portions 7C, 8C face, throughout the width of seal block 12. Seal block 12 is wound to the above side plates 7, 8 with a metal coil spring 6, then they are detachably connected to each other, and pump assembly 3 is assembled. By this assembly, inlet passage 13 (corresponding to a first fluid chamber in claims) is formed by grooved portions 7C, 8C and arc groove 12C. Seal block 12 is made from materials such as aluminum that has lower hardness than that of side plates 7, 8.

Metal coil spring 6 is a preliminary connecting member when fluid pressure does not occur. Pump assembly 3 is configured so that a contact force between side plates 7, 8 and seal block 12 builds up by a pressure difference between a high pressure generated around pump assembly 3 and a negative pressure in inlet passage 13 when the fluid pressure occurs.

At an outside in radial direction of seal block 12 (at a side of the pump housing), a support point 12D is formed in the axial direction. This support point 12D is formed in an obtuse angle so that support point 12D line contacts abutting surface 101*b*.

(Regarding Pump's Driving Action)

Next, the pump's driving action will be explained. As driving shaft 10A is driven by the motor, driven gear 11 is driven via driving gear 10. By this action, low pressure fluid is introduced from inlet passage 13 communicating with inlet port 2*a*, and high pressure fluid is output into a high pressure chamber 16 (corresponding to a second fluid chamber in claims) formed between cylinder bore 1*b* and pump assembly 3. This high pressure fluid is output from discharge port 1*c* to hydraulic equipment etc that is not shown.

(Structure of Rib)

Figure 4:
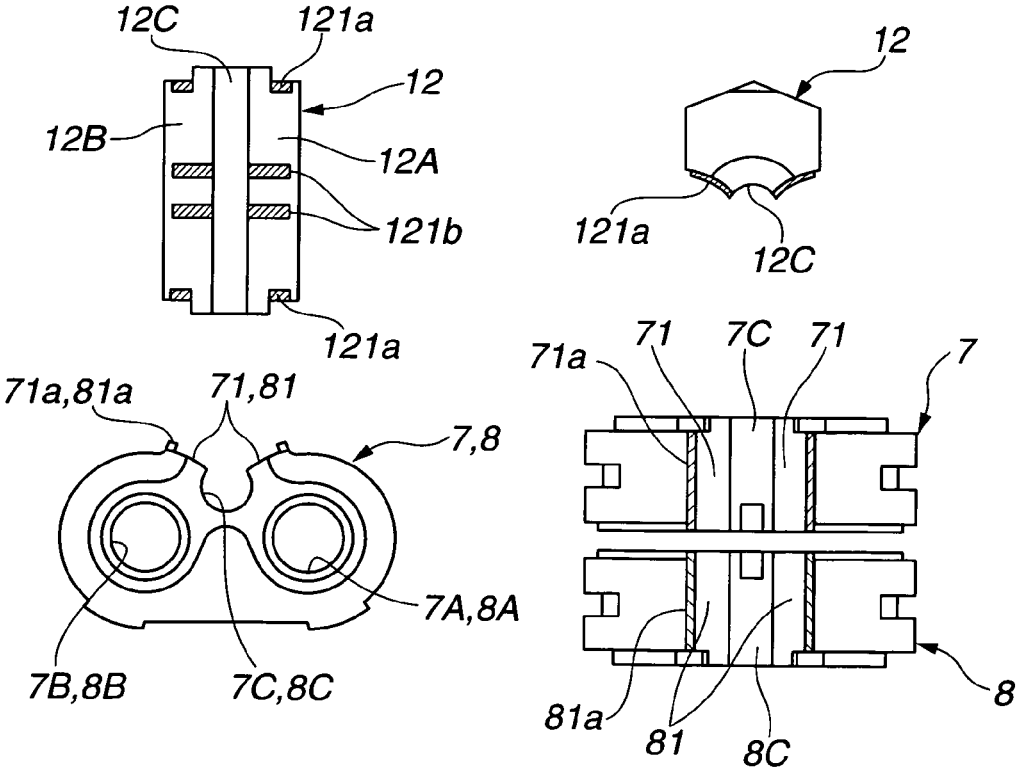
FIG. 4 is a diagram showing a seal block and a side plate of the embodiment 1.
Figure 5:
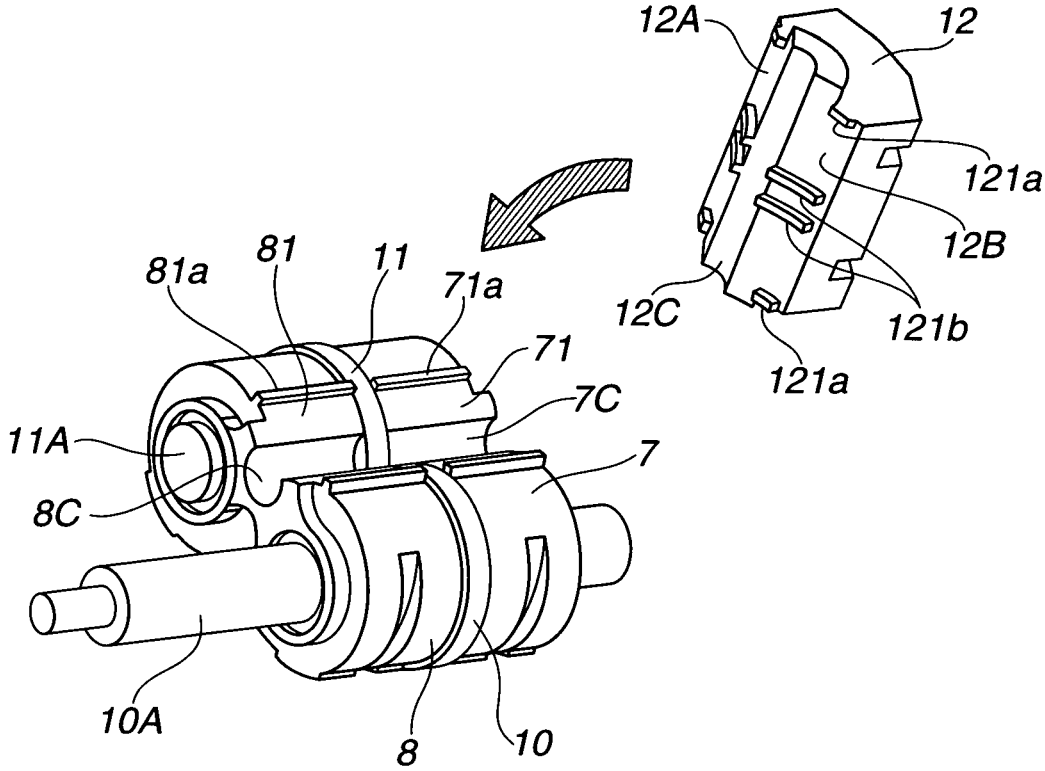
FIG. 5 is a perspective view showing a state in which the seal block is installed on a sub-assembly in the embodiment 1.
Figure 6:
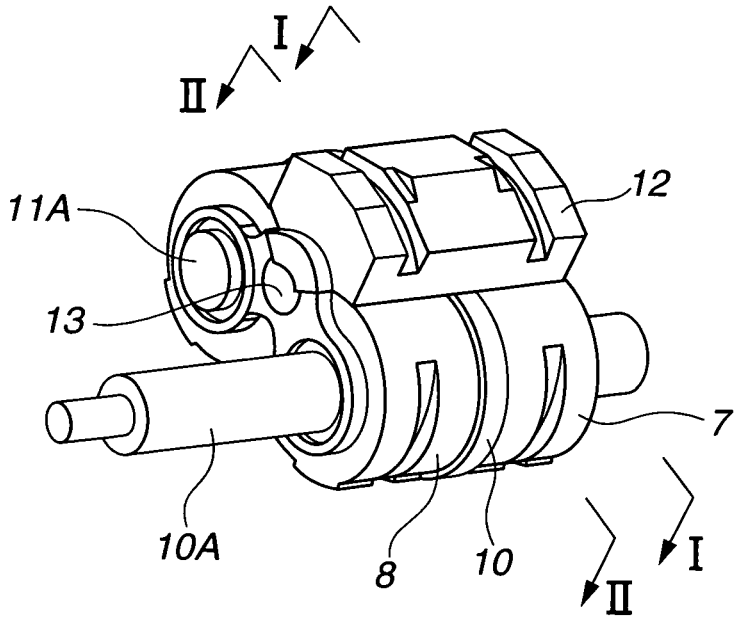
FIG. 6 is a perspective view showing an assembled state in the embodiment 1.

Next, rib structure will be explained. FIG. 4 shows bottom and side views of seal block 12, and side and top views of side plates 7, 8. FIG. 5 is a perspective view at an assembly in which seal block 12 is installed onto a sub-assembly in which driving shaft 10A having driving gear 10, driven shaft 11A having driven gear 11, and side plates 7, 8 are assembled (this state is defined as a sub-assembled state). FIG. 6 is a perspective view of a state in which seal block 12 has been installed onto the sub-assembly (this installed state is defined as an assembled state).

On recessed curved surfaces 12A, 12B of seal block 12, ribs 121*a* and 121*b* in transverse direction in FIG. 4 are respectively formed. Rib 121*a* seals a boundary surface between seal ring 19 and the assembly. Rib 121*b* seals boundary surfaces between driving and driven gears 10, 11 and the assembly (that is, rib 121*b* seals a gear room (not shown) in which driving and driven gears 10, 11 are accommodated).

On the other hand, at the upper surface sides of side plates 7, 8, ribs 71*a* and 81*a* in longitudinal direction in FIG. 4 are respectively formed on convex curved surfaces 71 and 81 that face recessed curved surfaces 12A, 12B of seal block 12. These ribs 71*a* and 81*a* are disposed at the farthest positions from grooved portions 7C, 8C on convex curved surfaces 71, 81, and seal boundary surfaces between high pressure chamber 16 and inlet passage 13. By these ribs, liquid or fluid tightness between the first and second fluid chambers is secured by way of the next processes.

(Regarding Production Process)

Figure 7:
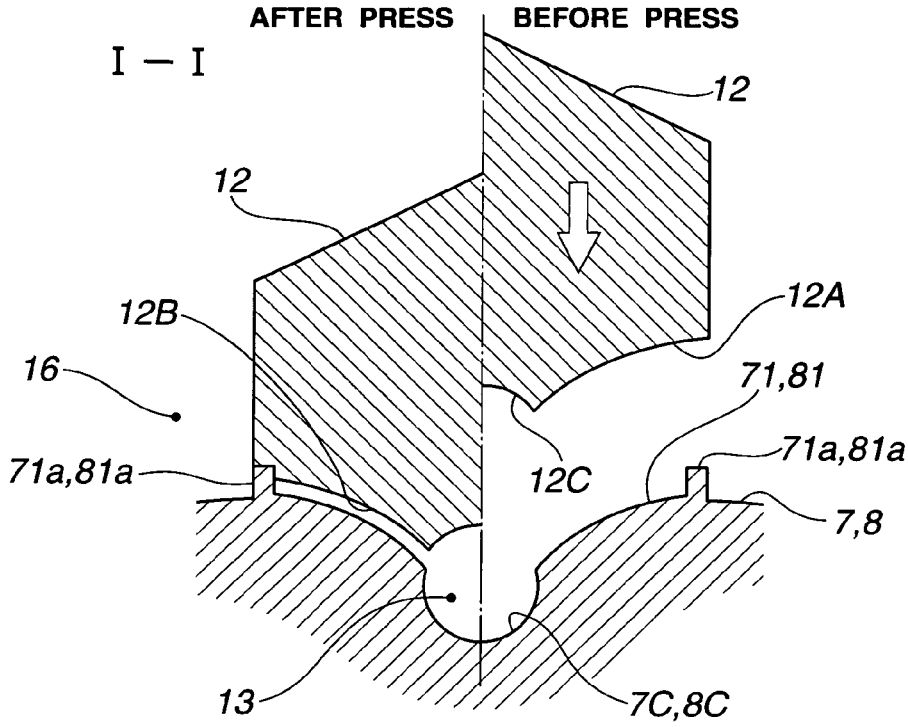
FIG. 7 is a sectional view taken along the line I-I in a second process in the embodiment 1.

Next, production process will be explained. FIG. 7 is a schematic explanation view showing a relation between seal block 12 and side plates 7, 8 before and after a press.

(A First Process)

Firstly, seal block 12 is installed onto the sub-assembly shown in FIG. 5, and the assembled state shown in FIG. 6 is given (before the press).

(A Second Process)

Figure 8:
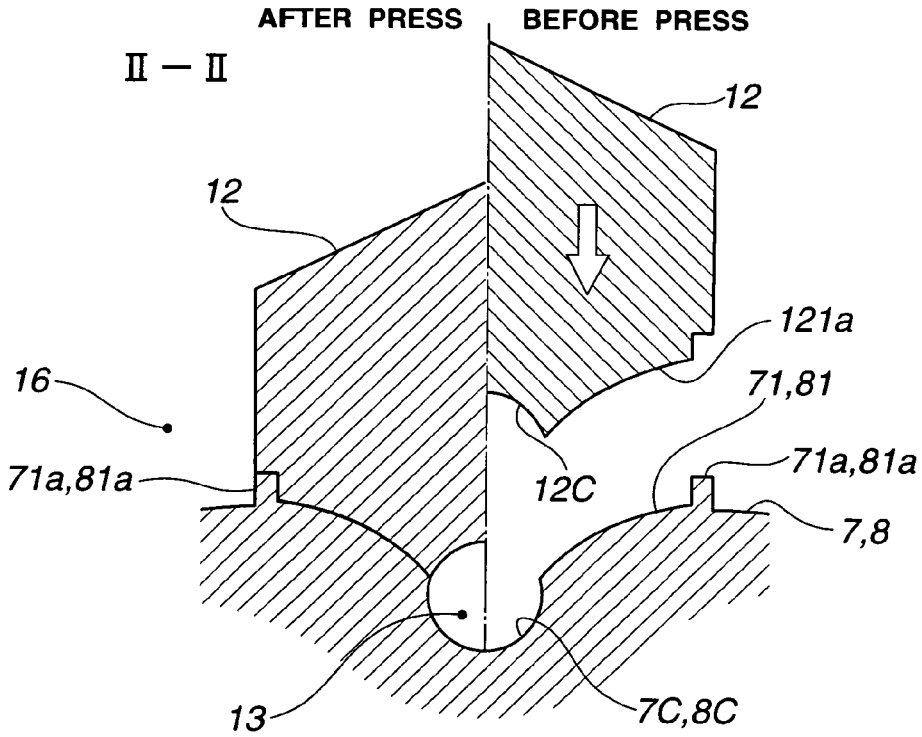
FIG. 8 is a sectional view taken along the line II-II in the second process in the embodiment 1.

From the assembled state shown in FIG. 6, seal block 12 is pressed against the sub-assembly (pressed into the sub-assembly). At this time, as shown by I-I sectional view in FIG. 7, seal block 12 is plastically deformed so that ribs 71*a* and 81*a* provided for side plates 7, 8 sink into the sides of recessed curved surfaces 12A, 12B of seal block 12. Further, as shown by II-II sectional view in FIG. 8, ribs 121*a* and 121*b* provided for seal block 12 abut on convex curved surfaces 71, 81 of side plates 7, 8, and thereby plastically deforms seal block 12.

By the above processes in which seal block 12 is plastically deformed from the sub-assembled state, even if there are variations in accuracy of side plates 7, 8 or driving and driven shafts 10A, 11A, it becomes possible to ensure optimum seal surfaces. And also, it is possible to achieve high pumping power while reducing the parts count.

In addition, ribs, provided for each member of the side plates 7, 8 and seal block 12, are formed in one direction. This therefore allows molding by a simple mold. Further, it is possible to cut down on costs.

Furthermore, ribs 71*a* and 81*a* are formed at the farthest positions from grooved portions 7C, 8C. Accordingly, it becomes possible that a low pressure area between recessed curved surfaces 12A, 12B and convex curved surfaces 71, 81, which communicates with inlet passage 13, expands. Then, push pressure exerted on seal block 12, which presses seal block 12 against side plates 7, 8, can increase, and further, seal integrity between high pressure chamber 16 and inlet passage 13 can improve.

Moreover, seal block 12 is plastically deformed so that ribs 71*a* and 81*a* sink into the sides of seal block 12. Because of this, two seal surfaces between ribs 71*a* and 81*a* and seal block 12 are obtained at each top surface portion and each side portion of the ribs 71*a* and 81*a*. Then, the seal integrity can further improve.

Next, types in which the ribs are provided for both side plates 7, 8 and seal block 12 will be enumerated below.

An Embodiment 1-1

Figure 9:
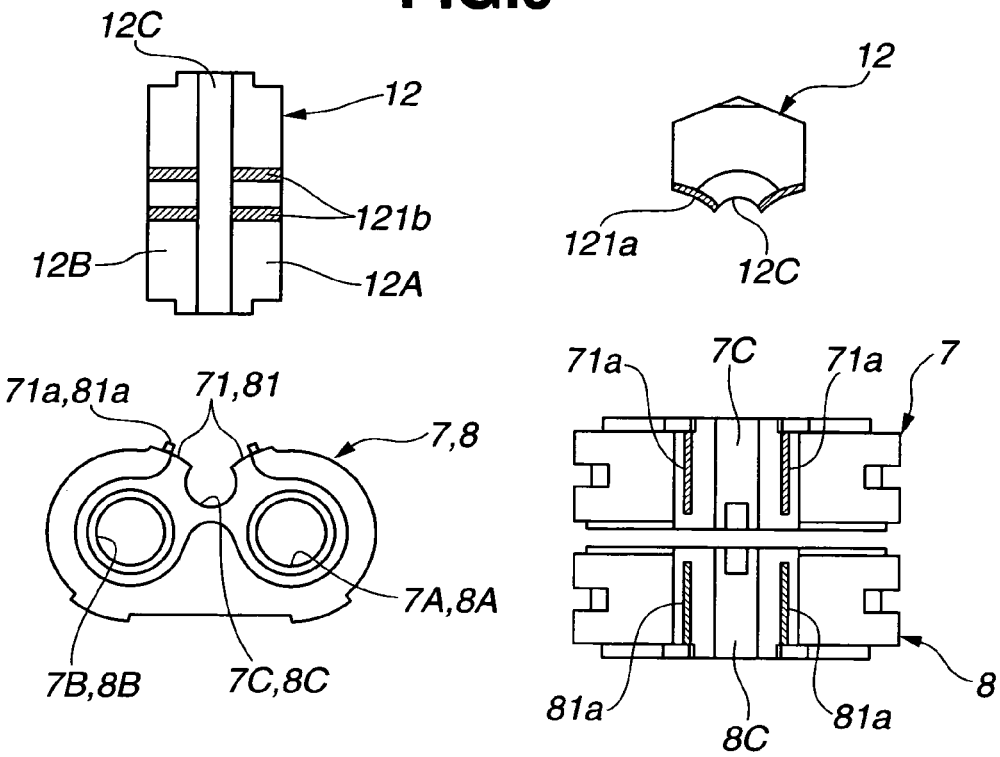
FIG. 9 is a diagram showing a seal block and a side plate of an embodiment 1-1.

FIG. 9 is drawings showing that only ribs 121*b* in transverse direction in the drawing which seal boundary surfaces between driving and driven gears 10, 11 and the assembly are provided for seal block 12, and ribs 71*a* and 81*a* in longitudinal direction in the drawing are provided at the substantially center of convex curved surfaces 71, 81 of side plates 7, 8. Since ribs 71*a* and 81*a* are formed at the substantially center of convex curved surfaces 71, 81, after pressing seal block 12 into the sub-assembly, three seal surfaces are obtained at each top surface portion and each two side portions of the ribs 71*a* and 81*a*. Then, the seal integrity can further improve.

An Embodiment 1-2

Figure 10:
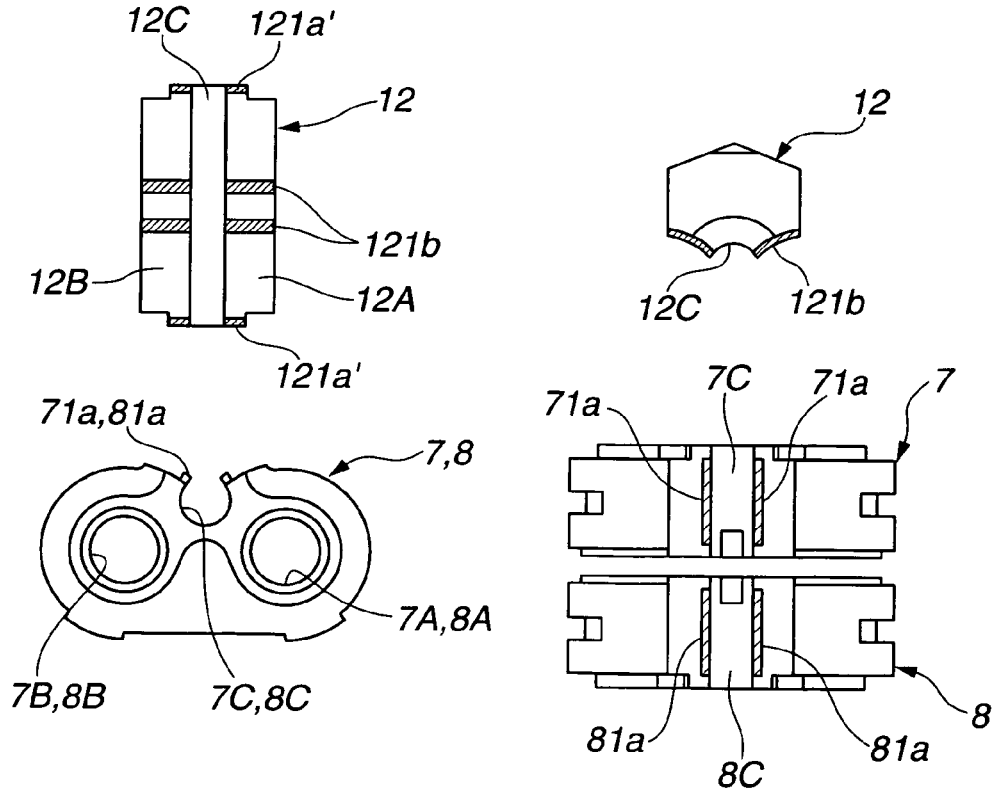
FIG. 10 is a diagram showing a seal block and a side plate of an embodiment 1-2.

FIG. 10 is drawings showing that ribs 121*a*' in transverse direction in the drawing which seal end portion sides positioned outwardly from boundary surfaces between seal ring 19 and the assembly are provided for seal block 12, and ribs 121*b* in transverse direction in the drawing which seal boundary surfaces between driving and driven gears 10, 11 and the assembly are provided for seal block 12, and ribs 71*a* and 81*a* in longitudinal direction in the drawing are provided at boundary portions between convex curved surfaces 71, 81 and grooved portions 7C, 8C of side plates 7, 8.

An Embodiment 1-3

Figure 11:
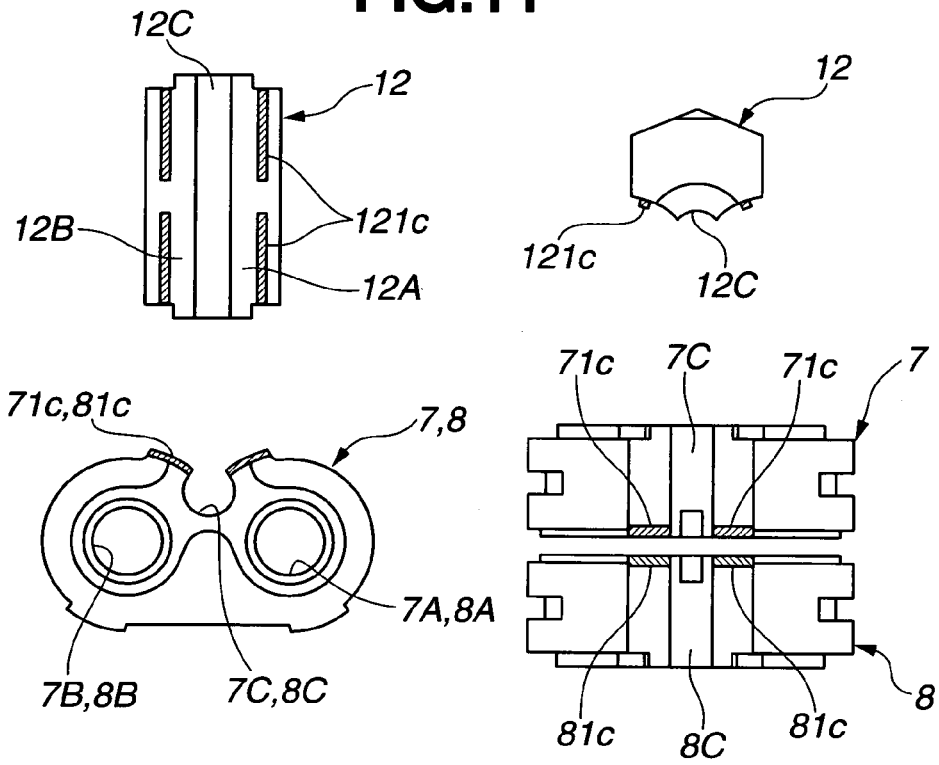
FIG. 11 is a diagram showing a seal block and a side plate of an embodiment 1-3.

FIG. 11 is drawings showing that ribs 121*c* in longitudinal direction in the drawing are provided at the substantially center of recessed curved surfaces 12A, 12B of seal block 12, and ribs 71*c* and 81*c* in transverse direction in the drawing which seal boundary surfaces between driving and driven gears 10, 11 and the assembly are provided on convex curved surfaces 71, 81 of side plates 7, 8.

An Embodiment 1-4

Figure 12:
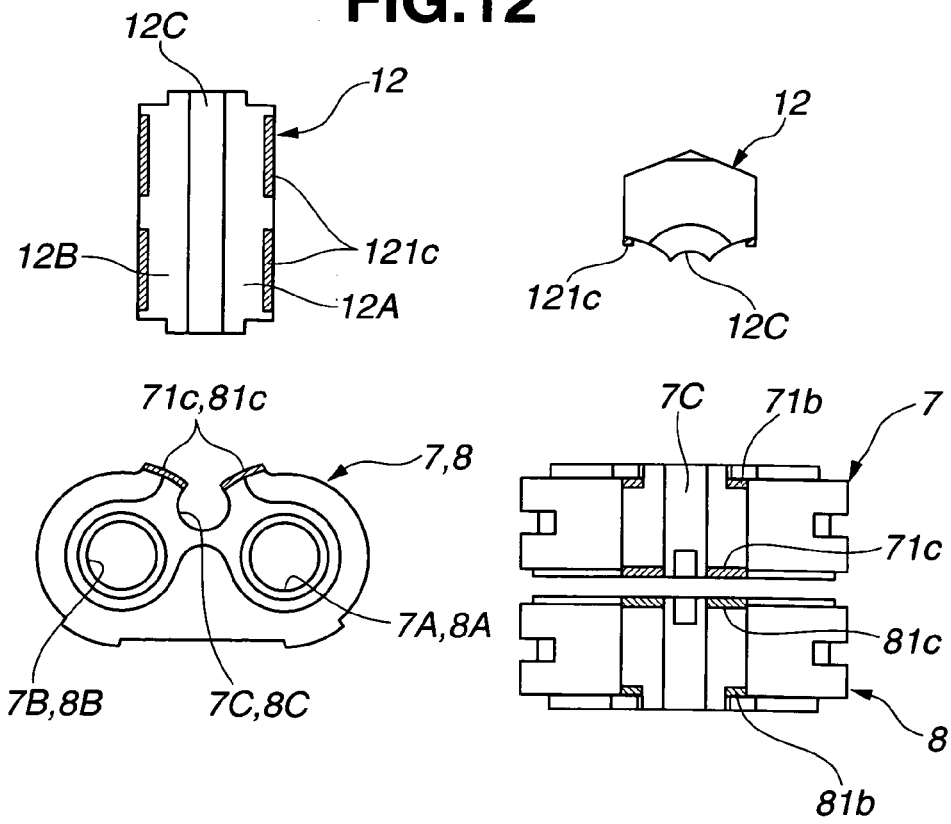
FIG. 12 is a diagram showing a seal block and a side plate of an embodiment 1-4.

FIG. 12 is drawings showing that ribs 121*c* in longitudinal direction in the drawing are provided at the farthest positions from arc groove 12C on recessed curved surfaces 12A, 12B of seal block 12, and ribs 71*b* and 81*b* in transverse direction in the drawing which seal boundary surfaces between seal ring 19 and the assembly are provided on convex curved surfaces 71, 81 of side plates 7, 8, and ribs 71*c* and 81*c* in transverse direction in the drawing which seal boundary surfaces between driving and driven gears 10, 11 and the assembly are provided on convex curved surfaces 71, 81 of side plates 7, 8.

An Embodiment 1-5

Figure 13:
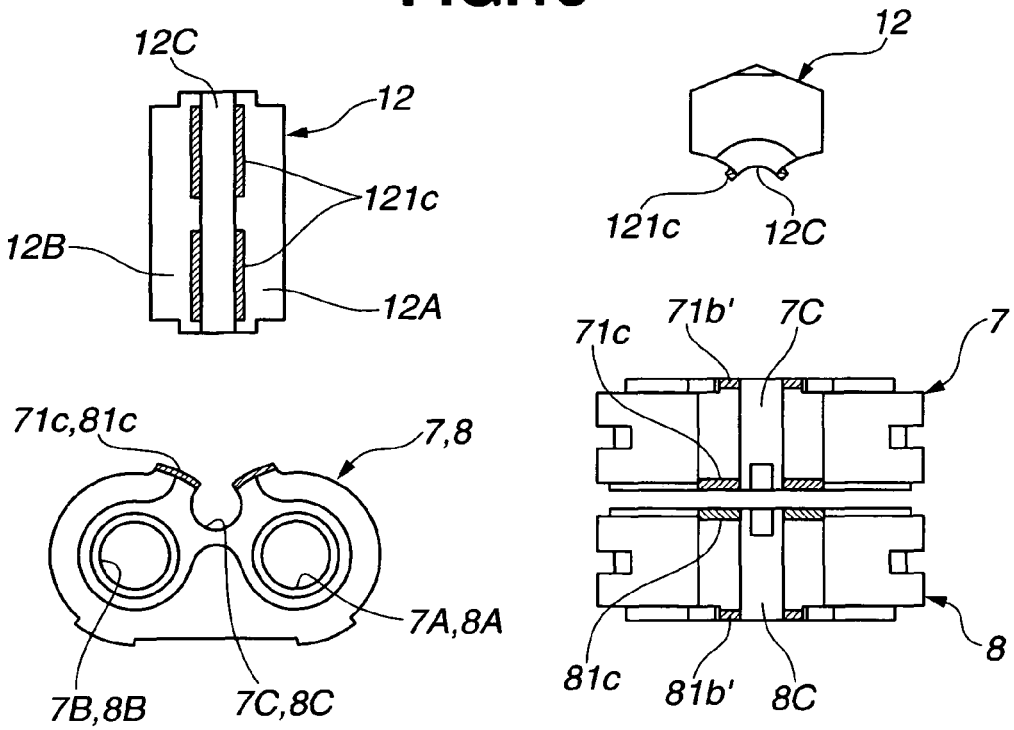
FIG. 13 is a diagram showing a seal block and a side plate of an embodiment 1-5.

FIG. 13 is drawings showing that ribs 121*c* in longitudinal direction in the drawing are provided at boundary portions between recessed curved surfaces 12A, 12B and arc groove 12C on recessed curved surfaces 12A, 12B of seal block 12, and ribs 71*b*' and 81*b*' in transverse direction in the drawing are provided at end portion sides positioned outwardly from boundary surfaces between seal ring 19 and the assembly on convex curved surfaces 71, 81 of side plates 7, 8, and ribs 71*c* and 81*c* in transverse direction in the drawing which seal boundary surfaces between driving and driven gears 10, 11 and the assembly are provided on convex curved surfaces 71, 81 of side plates 7, 8.

Basic effects of the above each embodiment 1-1, 1-2, 1-3, 1-4, 1-5 are similar to that of the embodiment 1. Their explanations are, therefore, omitted.

An Embodiment 2

Next, the embodiment 2 will be explained. Basic structure is similar to that of the embodiment 1. Because of this, only different points will be explained. In the embodiment 1, the ribs are provided for both side plates 7, 8 and seal block 12. However, as for the embodiment 2, its structure in which ribs are provided for either side plates 7, 8 or seal block 12 will be shown.

An Embodiment 2-1

Figure 14:
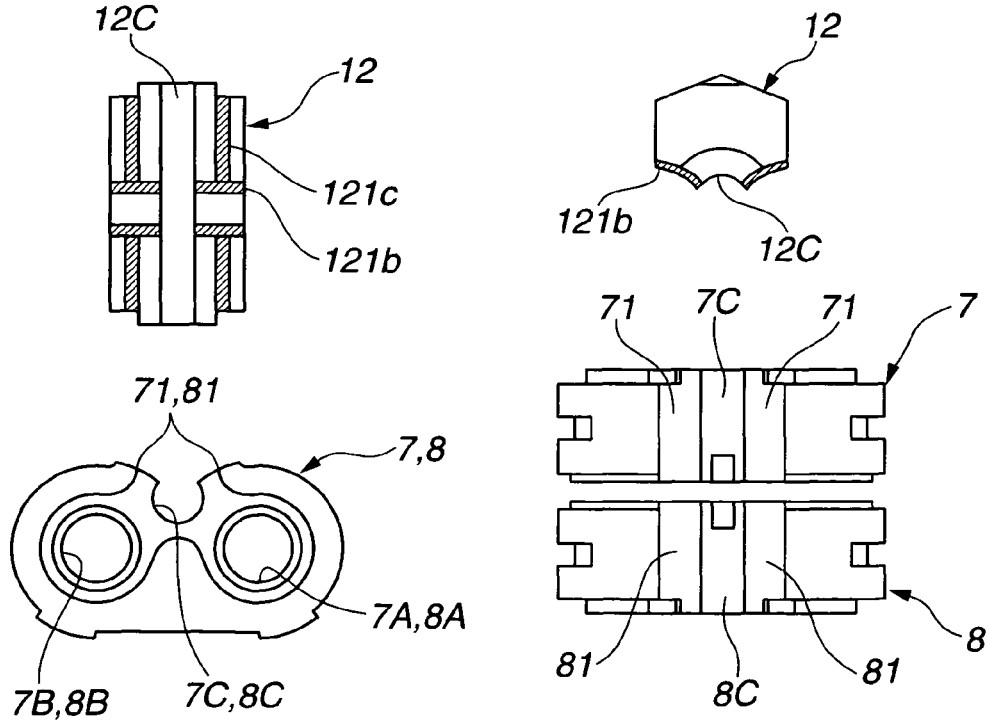
FIG. 14 is a diagram showing a seal block and a side plate of an embodiment 2-1.

FIG. 14 is drawings showing that ribs 121*c* in longitudinal direction in the drawing are provided at the substantially center of recessed curved surfaces 12A, 12B of seal block 12, and ribs 121*b* in transverse direction in the drawing which seal boundary surfaces between driving and driven gears 10, 11 and the assembly are provided on recessed curved surfaces 12A, 12B. Ribs 121*c* are positioned at the substantially center of ribs 121*b* in transverse direction. It therefore becomes possible to ensure low pressure receiving areas on convex curved surfaces 71, 81 of side plates 7, 8, and adhesion effect of the seal by the pressure difference can increase.

An Embodiment 2-2

Figure 15:
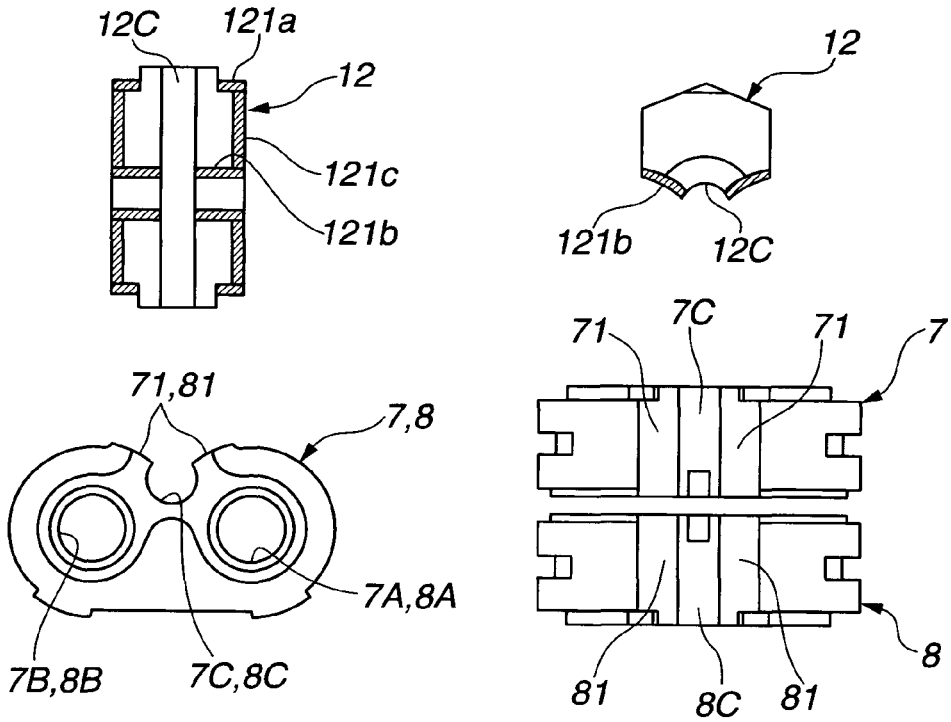
FIG. 15 is a diagram showing a seal block and a side plate of an embodiment 2-2.

FIG. 15 is drawings showing that ribs 121*a* in transverse direction in the drawing are provided at boundary surfaces between seal ring 19 and the assembly on recessed curved surfaces 12A, 12B of seal block 12, and ribs 121*c* in longitudinal direction in the drawing are provided at the farthest positions from arc groove 12C on recessed curved surfaces 12A, 12B of seal block 12, and ribs 121*b* in transverse direction in the drawing which seal boundary surfaces between driving and driven gears 10, 11 and the assembly are provided on recessed curved surfaces 12A, 12B.

An Embodiment 2-3

Figure 16:
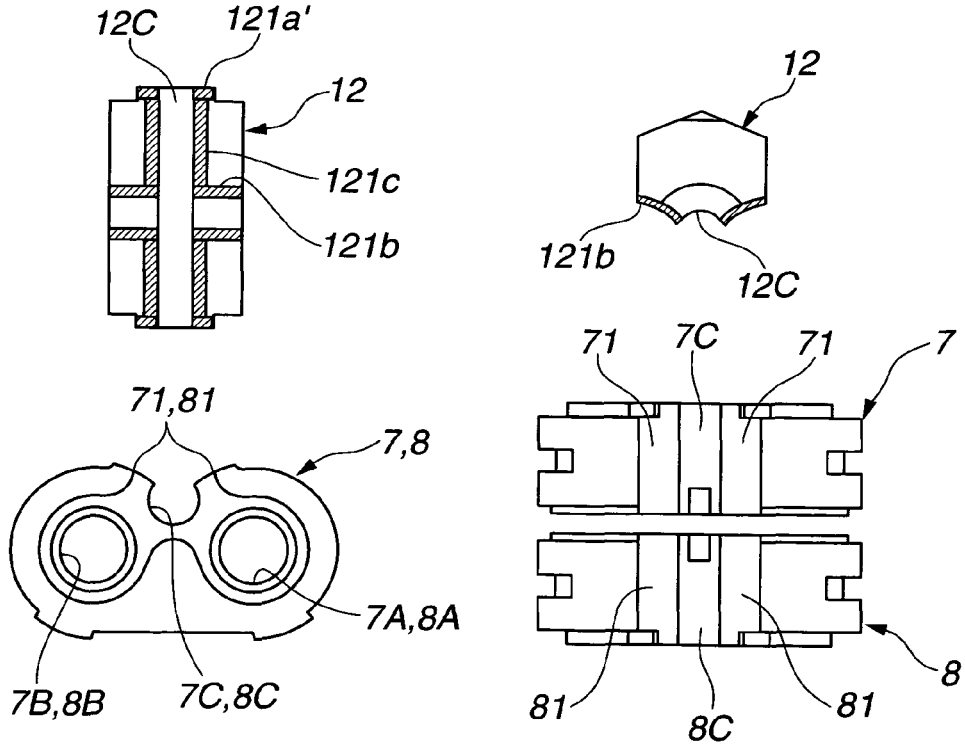
FIG. 16 is a diagram showing a seal block and a side plate of an embodiment 2-3.

FIG. 16 is drawings showing that ribs 121*a*' in transverse direction in the drawing which seal end portion sides positioned outwardly from boundary surfaces between seal ring 19 and the assembly are provided for seal block 12, and ribs 121*b* in transverse direction in the drawing which seal boundary surfaces between driving and driven gears 10, 11 and the assembly are provided for seal block 12, and ribs 121*c* in longitudinal direction in the drawing are provided at boundary portions between recessed curved surfaces 12A, 12B and arc groove 12C on recessed curved surfaces 12A, 12B.

An Embodiment 2-4

Figure 17:
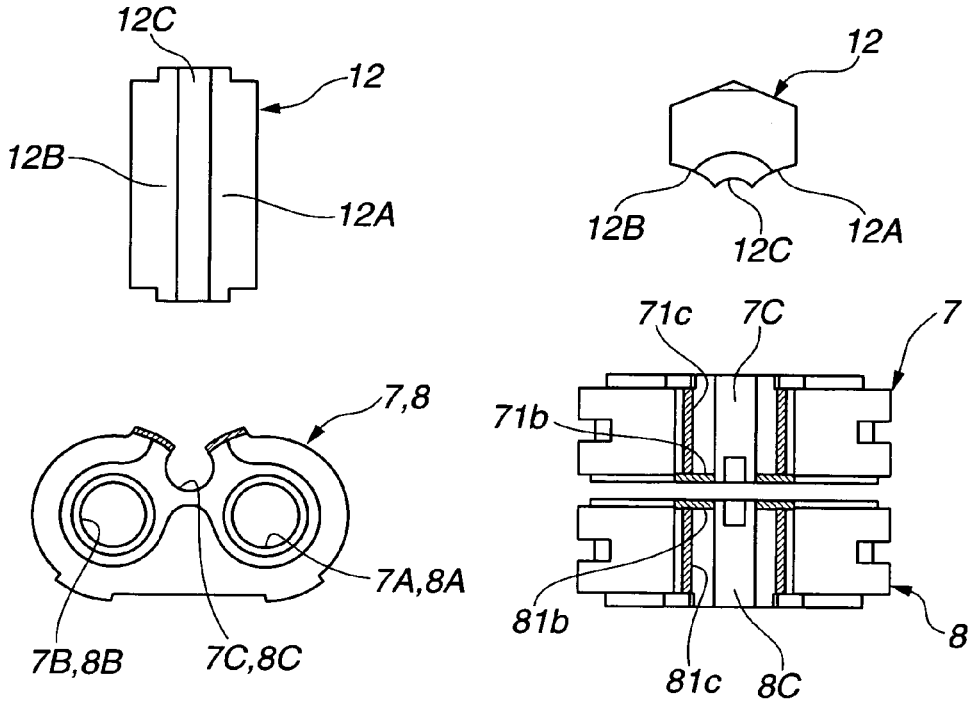
FIG. 17 is a diagram showing a seal block and a side plate of an embodiment 2-4.

FIG. 17 is drawings showing that ribs 71*c* and 81*c* in transverse direction in the drawing which seal boundary surfaces between driving and driven gears 10, 11 and the assembly are provided for side plates 7, 8, and ribs 71*a* and 81*a* in longitudinal direction in the drawing are provided at the substantially center of convex curved surfaces 71, 81.

An Embodiment 2-5

Figure 18:
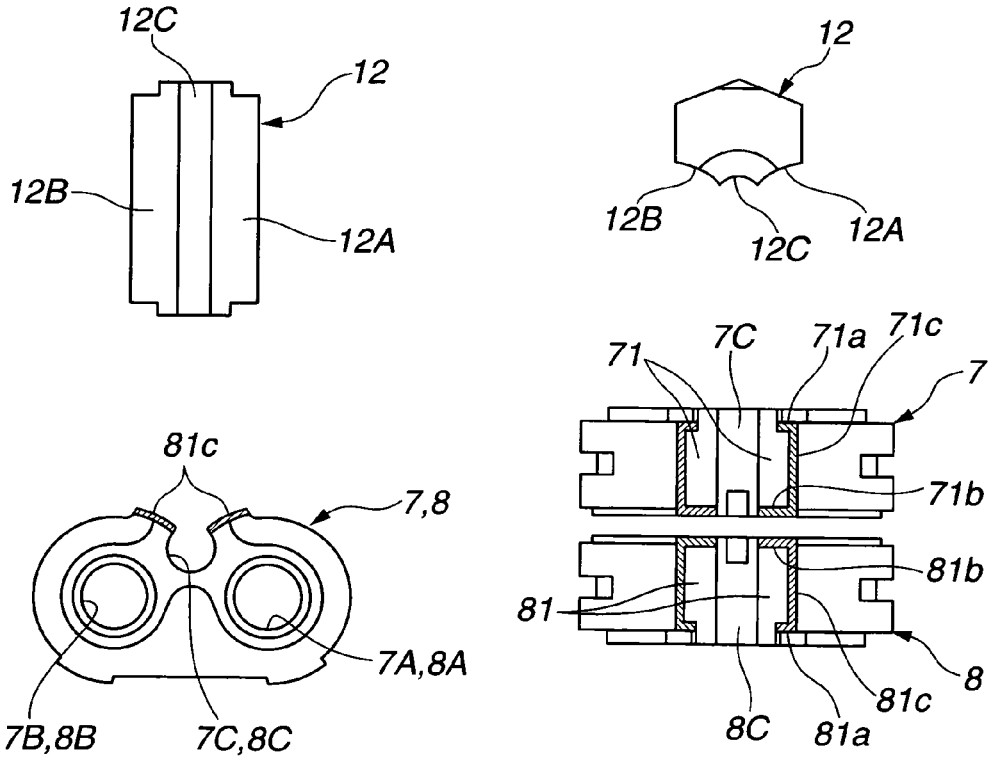
FIG. 18 is a diagram showing a seal block and a side plate of an embodiment 2-5.

FIG. 18 is drawings showing that ribs 71*b* 81*b* in transverse direction in the drawing which seal boundary surfaces between seal ring 19 and the assembly are provided for side plates 7, 8, and ribs 71*a* and 81*a* in longitudinal direction in the drawing are provided at the farthest positions from grooved portions 7C, 8C on convex curved surfaces 71, 81, and ribs 71*c* and 81*c* in transverse direction in the drawing which seal boundary surfaces between driving and driven gears 10, 11 and the assembly are provided for side plates 7, 8.

An Embodiment 2-6

Figure 19:
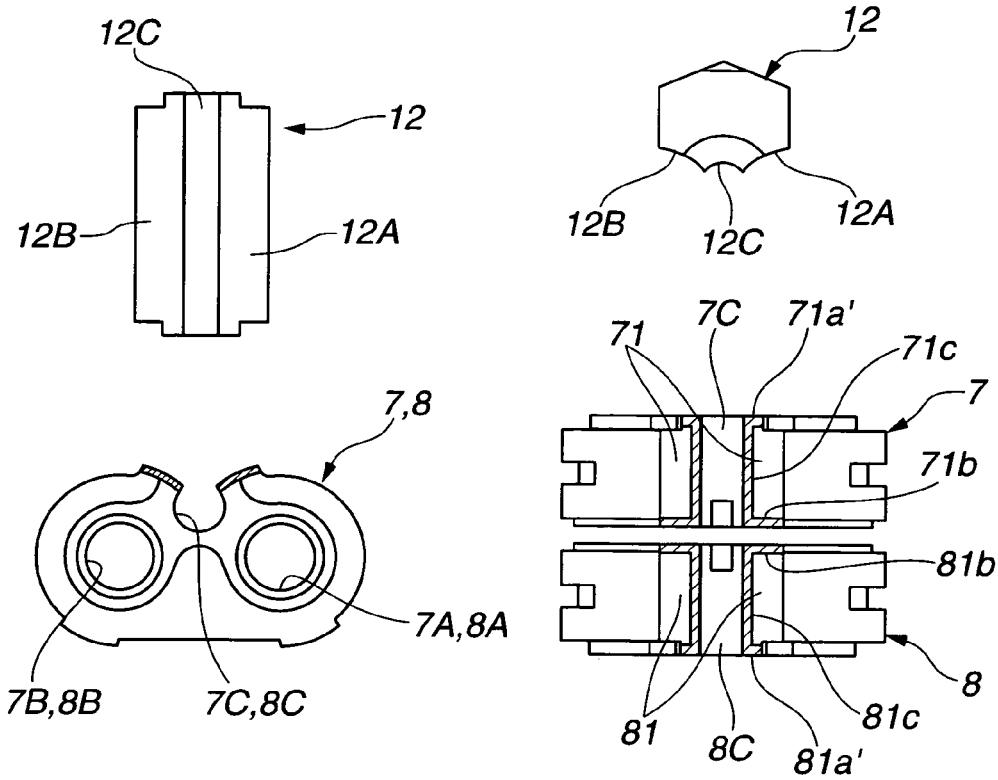
FIG. 19 is a diagram showing a seal block and a side plate of an embodiment 2-6.

FIG. 19 is drawings showing that ribs 71*b*' and 81*b*' in transverse direction in the drawing which seal end portion sides positioned outwardly from boundary surfaces between seal ring 19 and the assembly are provided for side plates 7, 8, and ribs 71*a* and 81*a* in longitudinal direction in the drawing are provided at boundary portions between convex curved surfaces 71, 81 and grooved portions 7C, 8C, and ribs 71*c* and 81*c* in transverse direction in the drawing which seal boundary surfaces between driving and driven gears 10, 11 and the assembly are provided for side plates 7, 8.

As explained above, the ribs are formed at only one member as shown in the above embodiments 2-1, 2-2, 2-3, 2-4, 2-5, 2-6, and thereby becomes unnecessary to change a design of the other member while achieving improvement of the seal integrity, as the embodiment 1, and while suppressing cost.

An Embodiment 3

Next, the embodiment 3 will be explained. Basic structure of the embodiment 3 is also similar to that of the embodiment 1. In the embodiment 1, the ribs are provided for both side plates 7, 8 and seal block 12. However, as for the embodiment 3, its structure will be shown in which T-shaped ribs 710, 810 and 711, 811 are provided for side plates 7, 8, and stoppers 712, 812 that are lower than ribs 710, 810 are provided at close to ribs 710, 810 and 711, 811, but seal block 12 is provided with no ribs.

Figure 20:
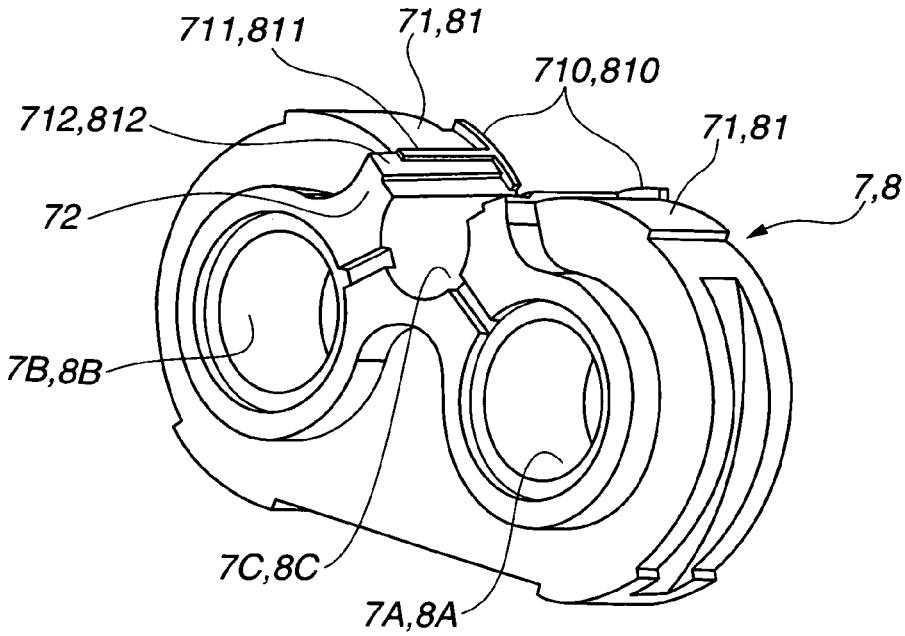
FIG. 20 is a perspective view showing a side plate of an embodiment 3.
Figure 21:
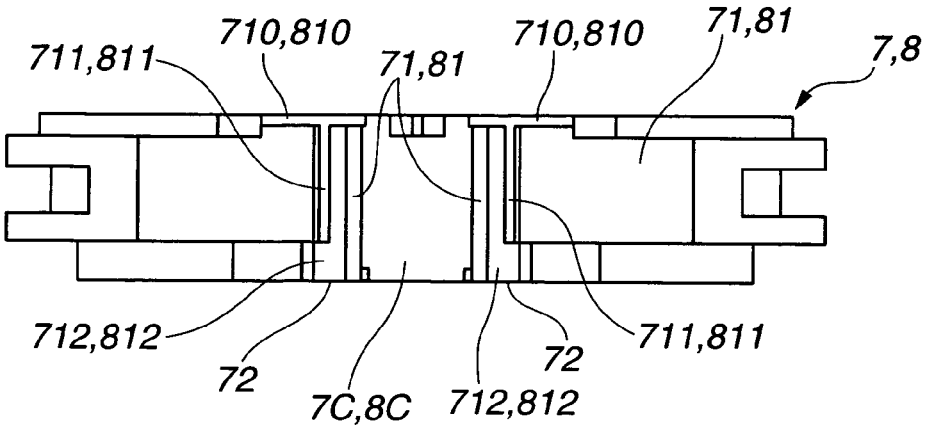
FIG. 21 is a front view, viewed from radial direction, showing the side plate of the embodiment 3.

FIG. 20 is a perspective view of side plates 7, 8, in which ribs 710, 810 that extend in the radial direction of pump (continuously extend in circumferential directions of driving and driven gears 10,11), and ribs 711, 811 that extend in the axial direction, and further stoppers 712, 812 are provided on convex curved surfaces 71, 81. FIG. 21 is a front view, viewed from the radial direction. Stoppers 712, 812 are provided such that the heights of stoppers 712, 812 are higher than convex curved surfaces 71, 81 and lower than ribs 710, 810 and 711, 811 (or tops of ribs 710, 810 and 711, 811). In addition, stoppers 712, 812 are provided such that surface area of stoppers 712, 812 is larger than total surface areas of ribs 710, 711 and, 810, 811 (hereinafter abbreviated as ribs 710 ~811). Further, ribs 711, 811 and stoppers 712, 812 are placed such that edges of ribs 711, 811 and outer edges of stoppers 712, 812 are aligned with each other. Moreover, the outer edges of stoppers 712, 812 abut on an inner circumference of seal ring 19.

When pressing seal block 12 into the sub-assembly, seal block 12 first abuts on each of the ribs 710~811, then abuts on stoppers 712, 812 after each of the ribs 710~811 is plastically deformed. At this time, a pushing load at the press of seal block 12 is properly set so that the pushing load increases at a brush when seal block 12 has abutted on stoppers 712, 812, and therefore only the each rib can be plastically deformed. Regarding the pushing load, the load can keep on being put until seal block 12 abuts on stoppers 712, 812 (that is, until spaces between side plates 7, 8 and seal block 12 reach positions of stoppers 712, 812). Or, it might be possible to keep on putting the load until seal block 12 has abutted on stoppers 712, 812 or until deformation of ribs 710 ~811 becomes a predetermied amount and more so that seal integrity is secured by stoppers 712, 812 even if the load exerted on seal block 12 changes due to variations of products.

That is to say, even if seal block 12 abuts on stoppers 712, 812, stoppers 712, 812 is almost not plastically deformed and seal block 12 abuts on surfaces of stoppers 712, 812 of side plates 7, 8 after the press of seal block 12. And then, the spaces whose heights correspond to that of stoppers 712, 812 are formed between seal block 12 and side plates 7, 8. Or, conversely, certain or more spaces are secured between seal block 12 and side plates 7, 8 by stoppers 712, 812. These spaces communicate with inlet passage 13, so that it becomes possible to ensure low pressure receiving areas in an inner circumferential surface of seal block 12, and to further improve the seal integrity.

In addition, in the embodiment 3, ribs 710~811 provided for side plates 7, 8 are plastically deformed, and the assembly is assembled so that the inner circumferential side of seal block 12 is not deformed. In the case of gear pump employing seal block 12, each part (the side plates or the seal block 12 and so on) adheres on each other by the pressure difference between inlet passage 13 and high pressure chamber 16 at the pump drive, and thereby ensure the seal integrity. At this time, in a case where the ribs etc provided for either one of side plates 7, 8 or seal block 12 are inserted into the other, there is a possibility that relative motion between seal block 12 and side plates 7, 8 may be hindered and therefore the improvement of the seal integrity will be hindered. Meanwhile, as for the embodiment 3, even though the improvement of the seal integrity is achieved by the plastic deformation, it does not hinder the relative motion.

(Regarding Effects of the Stopper at the Pump Drive)

Figure 22:
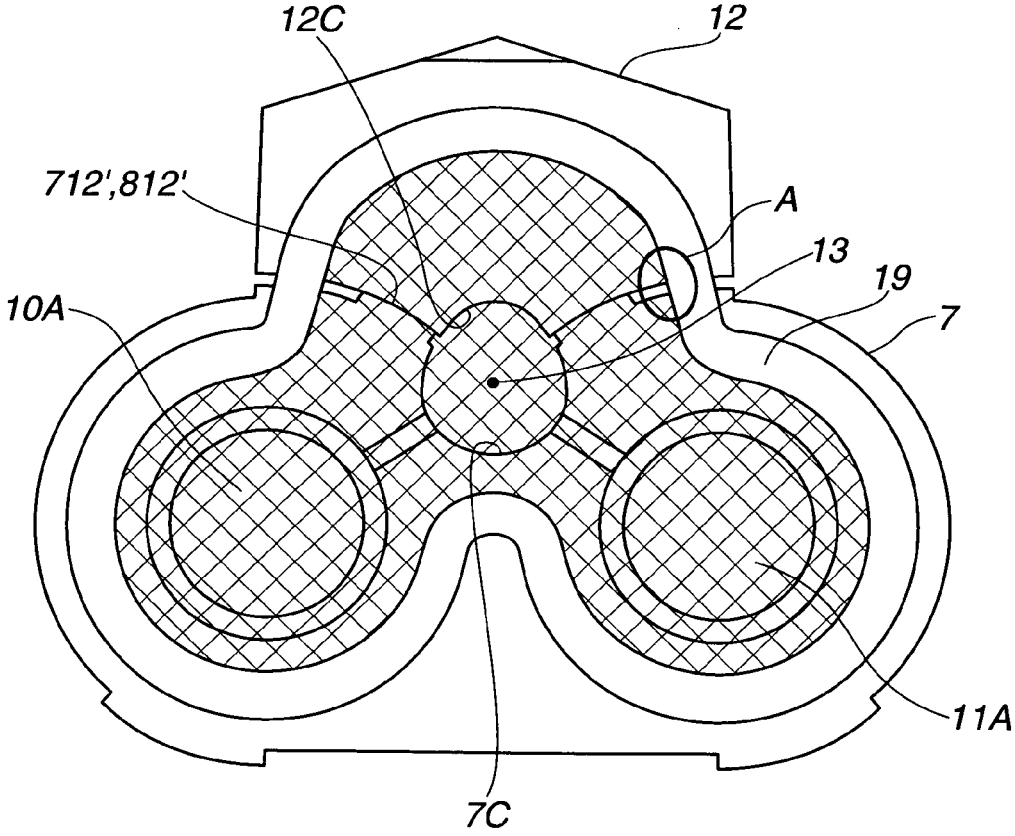
FIG. 22 is a front view showing a seal block and a side plate of a comparative example.
Figure 23:
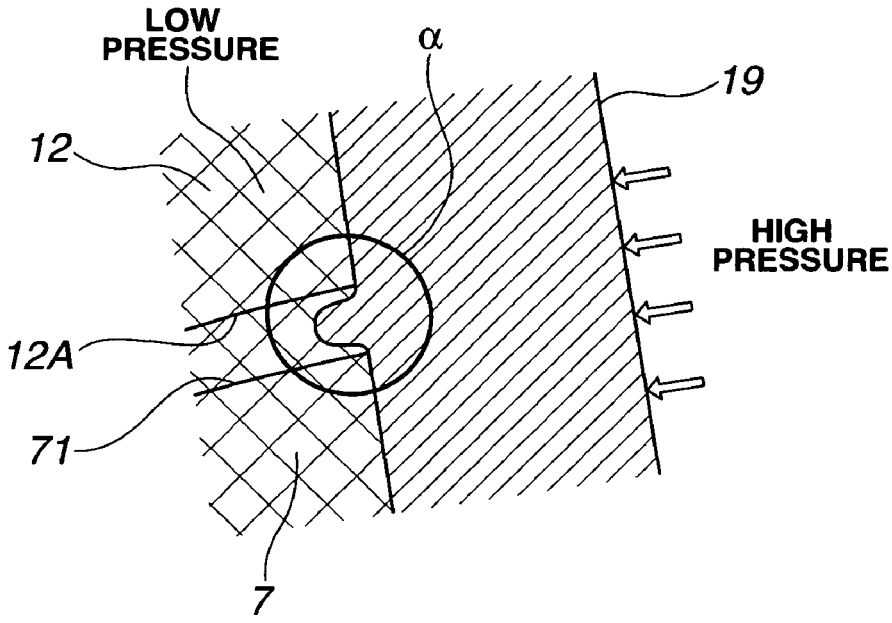
FIG. 23 is an enlarged view of an area A of the comparative example.

FIG. 22 is a diagram showing a comparative example in which outer edges of stoppers 712' and 812' do not abut on seal ring 19. This diagram of the comparative example is a front view of pump assembly 3 in the assembled state after the press of ribs 710, 711, and 810, 811, viewed from the axial direction. Low pressure area is shown by crosshatch. FIG. 23 is an enlarged-view of an area "A" in FIG. 22.

By the pump drive, the pressure difference, where an out side of seal ring 19 is high pressure and an inside of seal ring 19 is low pressure, occurs, and pump assembly 3 is sealed by seal ring 19 (especially, end portions in the axial direction of side plates 7, 8, with which seal ring 19 overlaps in the axial direction, hereinafter referred to as fringe portions 72 and 82). In the case of the comparative example, gaps whose heights correspond to that of stoppers 712, 812 are formed between side plates 7, 8 and seal block 12. Because of this, seal ring 19 is drawn into these gaps (see an area α in FIG. 23). And therefore, there is a risk that seal ring 19 drawn into the slight gaps between side plates 7, 8 and seal block 12 may be cut by being caught in the gap between side plates 7, 8 and seal block 12.

On the other hand, in the embodiment 3, stoppers 712, 812 are provided so that stoppers 712, 812 abut on seal ring 19. Accordingly, it becomes possible to eliminate the gap between side plates 7, 8 and seal block 12 (particularly, around fringe portions 72, 82), and thereby prevents seal ring 19 from being cut.

Next, types in which the stoppers are provided at close to the ribs of side plates 7, 8 will be enumerated below.

An Embodiment 3-1

Figure 24:
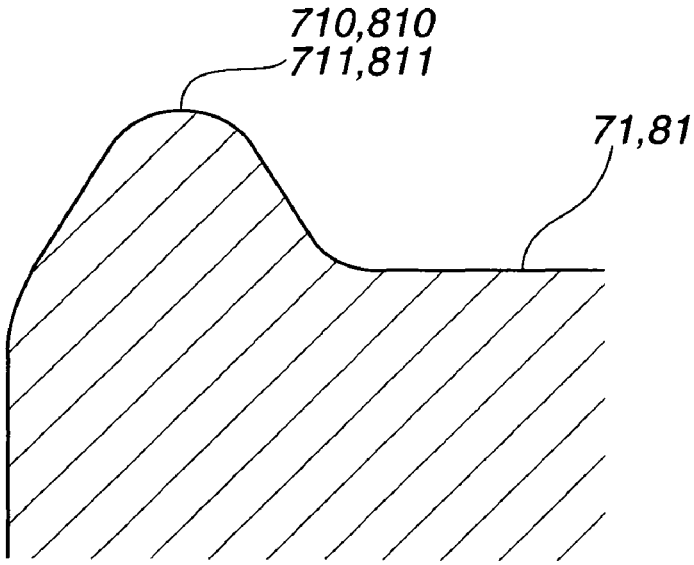
FIG. 24 is an enlarged view of a rib of an embodiment 3-1.
Figure 25:
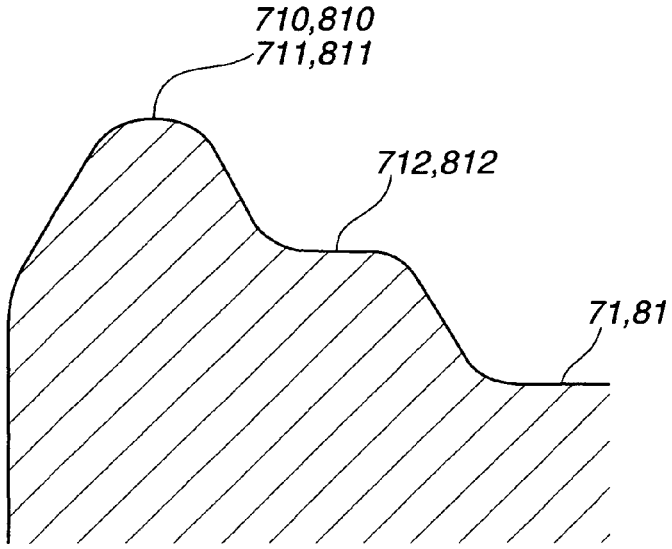
FIG. 25 is an enlarged view of the rib and a stopper of the embodiment 3-1.

FIG. 24 shows an example in which ribs 710~811 in the embodiment 3 are formed substantially in convex R-shape. By this, when the pushing load acts on side plates 7, 8, ribs 710~811 can be plastically deformed smoothly. FIG. 25 is an example in which stoppers 712, 812 are provided continuously from convex R-shaped ribs. By this, when the pushing load acts on side plates 7, 8, stress does not concentrate at a part of the rising portion of convex portion of rib, and therefore ribs 710~811 can be plastically deformed smoothly. Here, the rib is not necessarily formed in T-shape as the embodiment 3, and it is not particularly limited.

An Embodiment 3-2

Figure 26:
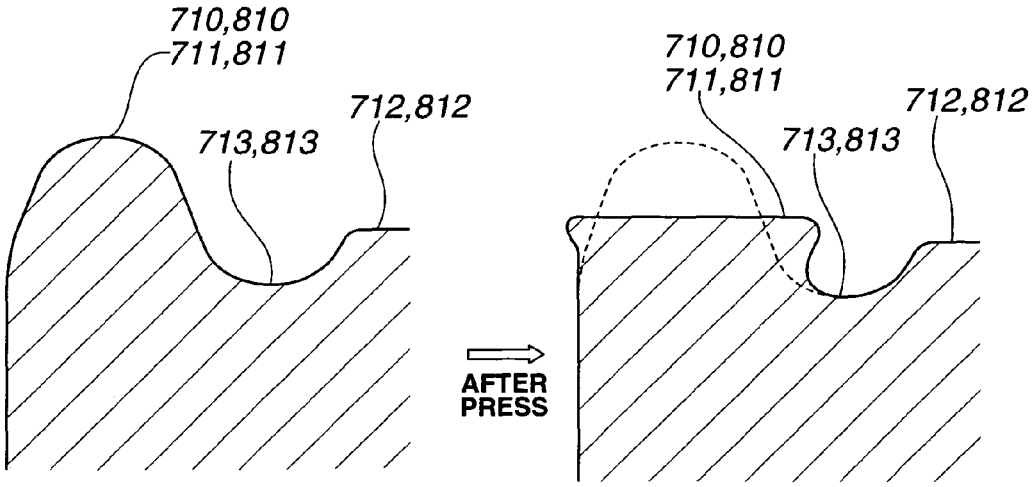
FIG. 26 is an enlarged view of a rib and a stopper of an embodiment 3-2.

FIG. 26 is an example in which clearance portions 713 and 813 are formed between convex R-shaped ribs 710~811 and stoppers 712, 812, or formed continuously with convex R-shaped ribs 710~811,and it shows the example before and after the press of seal block 12. A surplus material which appears by the press escapes into clearance portions 713 and 813, and therefore ribs 710~811 can be plastically deformed smoothly.

An Embodiment 3-3

Figure 27:
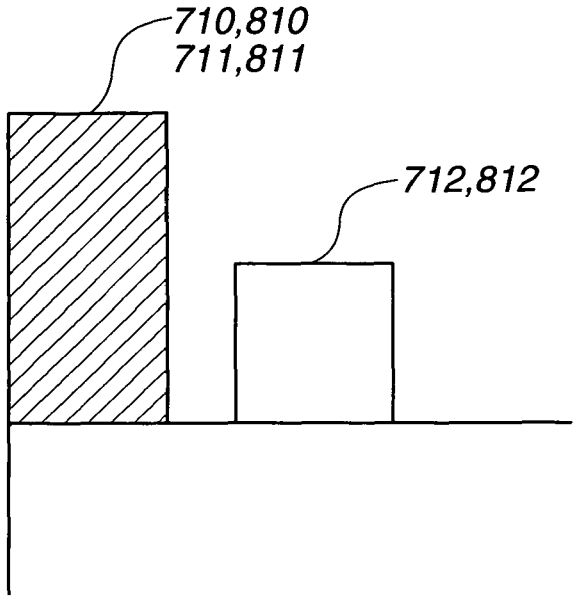
FIG. 27 is a schematic diagram of a rib and a stopper of an embodiment 3-3.

FIG. 27 is a schematic diagram in which ribs 710~811 (oblique lines) and stoppers 712, 812 (white space) are separately formed. Even if the ribs are crushed by the press, only higher portions of the ribs than the stoppers are plastically deformed, and spaces whose heights correspond to that of the stoppers are secured between side plates 7, 8 and seal block 12.

An Embodiment 3-4

Figure 28:
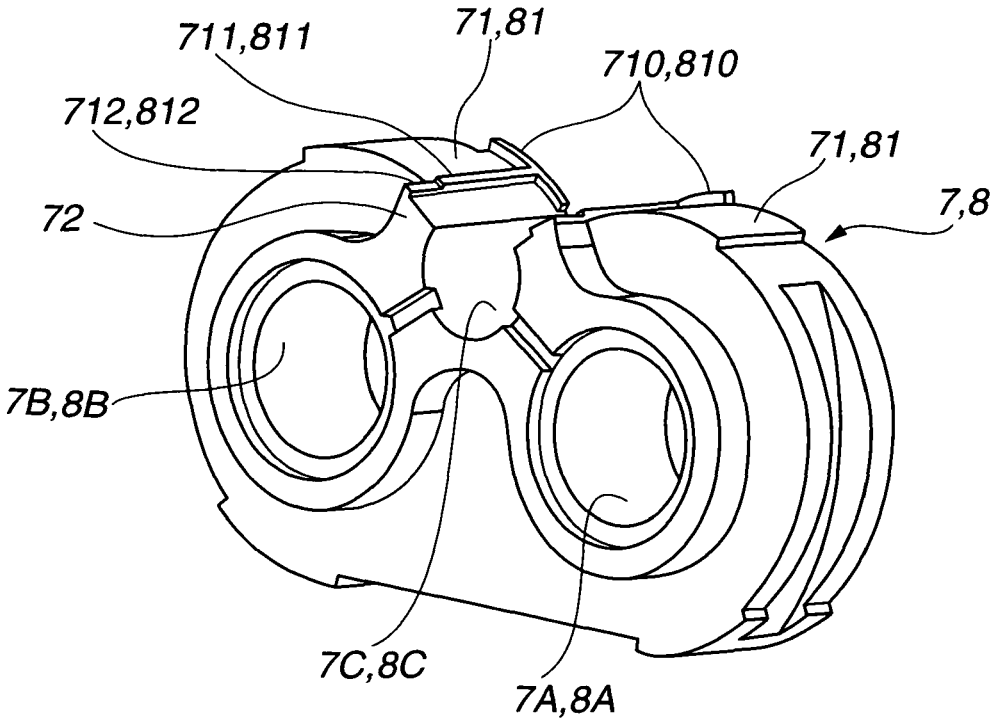
FIG. 28 is a perspective view showing a side plate of an embodiment 3-4.
Figure 29:
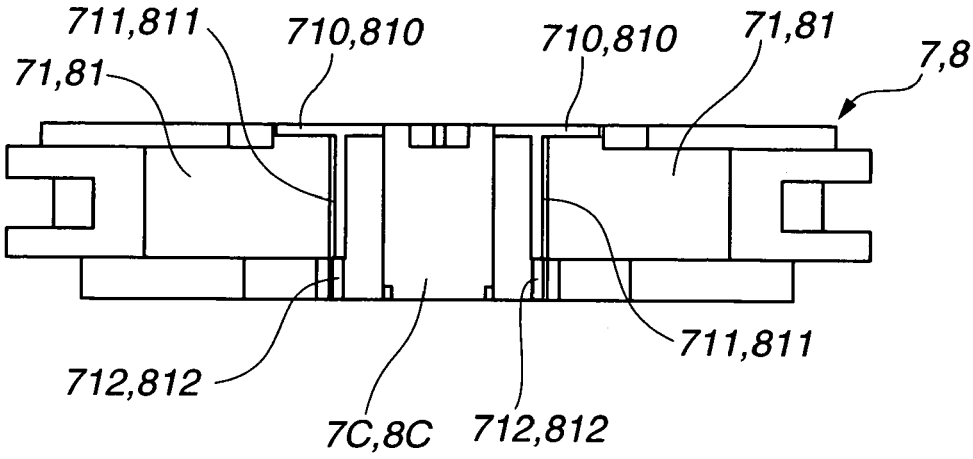
FIG. 29 is a front view, viewed from radial direction, showing the side plate of the embodiment 3-4.

FIG. 28 is a perspective view of side plates 7, 8 of an example in which stoppers 712, 812 are provided at extensions of ribs 711, 811. FIG. 29 is a front view, viewed from the radial direction. In this case, since surface area of stoppers 712, 812 is smaller than total surface areas of ribs 710~811, stoppers 712, 812 are also slightly plastically deformed at the press. Although stoppers 712, 812 are slightly plastically deformed, contact areas between side plates 7, 8 and seal block 12 increase rapidly and contact pressures decrease rapidly at the point when ribs 710~811 are crushed and their heights become the same heights as stoppers 712, 812. For this reason, stoppers 712, 812 are not completely crushed, and spaces of certain value or higher can be secured between side plates 7, 8 and seal block 12.

In addition, as compared with the embodiment 3 shown in FIG. 20, areas of stoppers 712, 812 are smaller. It is therefore possible to increase an area of the low pressure area that communicates with inlet passage 13, and to certainly improve the seal integrity.

An Embodiment 3-5

Figure 30:
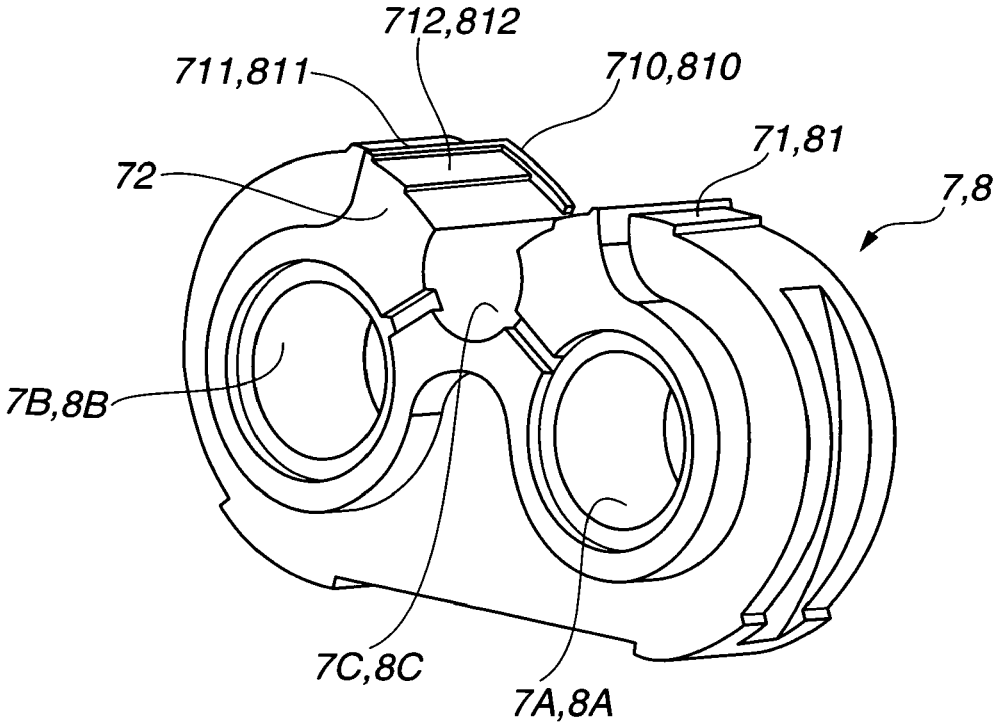
FIG. 30 is a perspective view showing a side plate of an embodiment 3-5.
Figure 31:
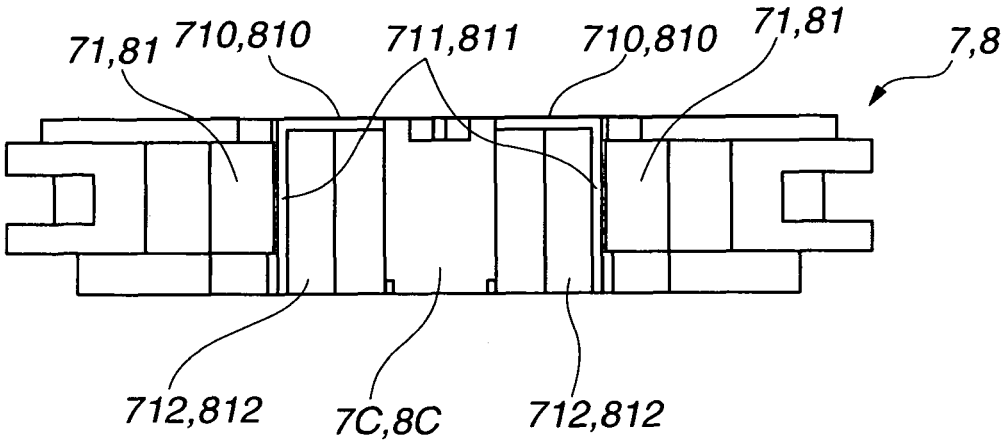
FIG. 31 is a front view, viewed from radial direction, showing the side plate of the embodiment 3-5.

FIG. 30 is a perspective view showing a case in which ribs 710~811 are formed in L-shape. FIG. 31 is its front view, viewed from radial direction. Stoppers 712, 812 are provided at center side as compared with ribs 710~811. As described above, ribs 710, 810 in the radial direction and ribs 711, 811 in the axial direction are formed in the L-shape, so that it becomes possible to widely form an area that communicates with inlet passage 13 and to improve the seal integrity between seal block 12 and side plates 7, 8.

An Embodiment 3-6

Figure 32:
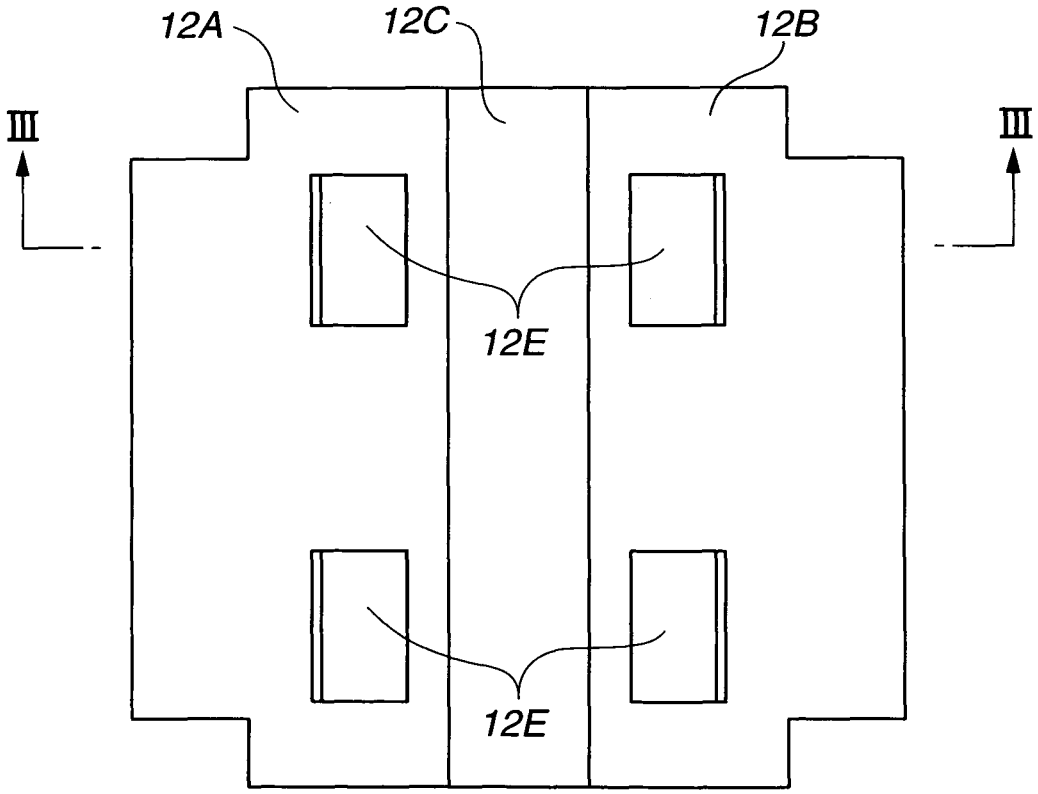
FIG. 32 is a front view of a side of an abutting surface, showing a seal block of an embodiment 3-6.
Figure 33:
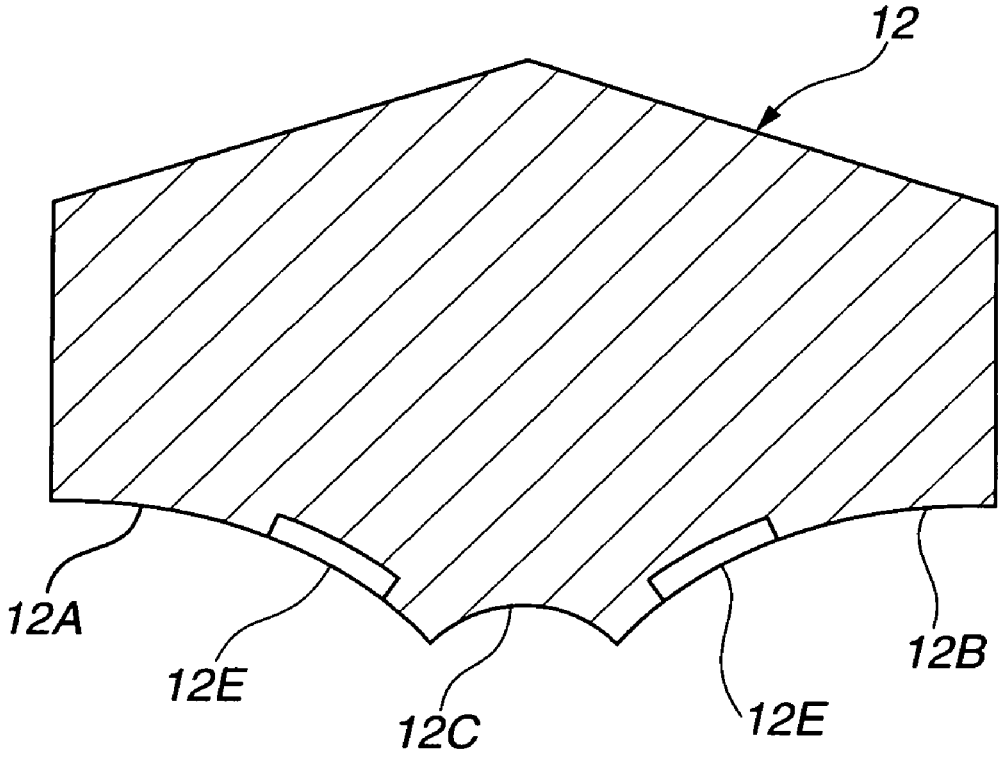
FIG. 33 is a sectional view taken along the line III-III, showing the seal block of the embodiment 3-6.
Figure 34:
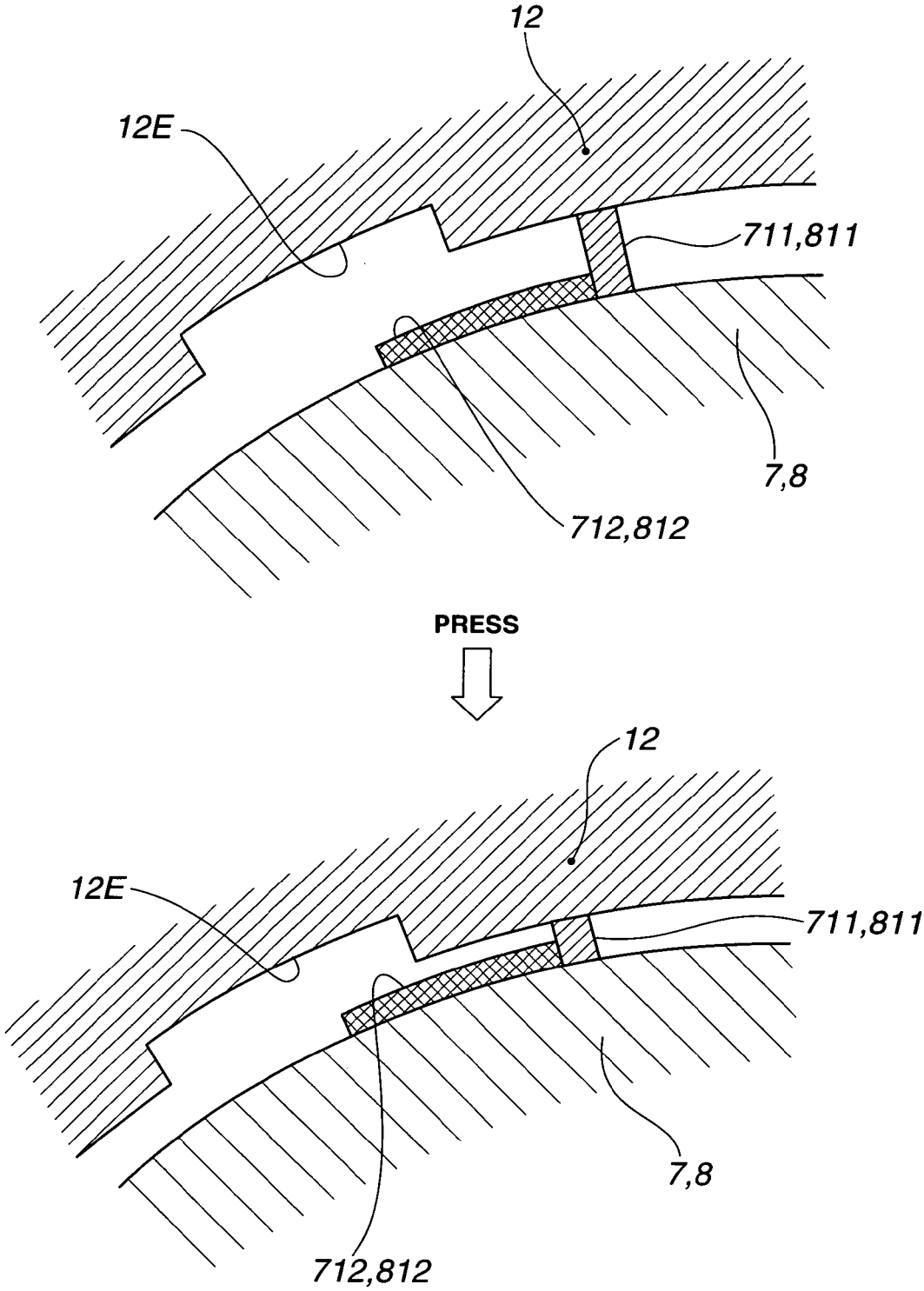
FIG. 34 is a diagram showing a state in which the seal block is pressed into a side plate in the embodiment 3-6.

FIGS. 32 and 33 are an example in which recessed portions 12E are provided at recessed curved surfaces 12A, 12B of seal block 12, on which side plates 7, 8 abut. FIG. 32 is a front view, viewed from radial direction. FIG. 33 is a sectional view taken along the line III-III. FIG. 34 is a sectional view in radial direction of the abutting surface before and after the press.

Recessed portions 12E are provided at center side of seal block 12 as compared with ribs 711, 811 so that ribs 711, 811 do not abut on recessed portions 12E themselves. After the press, recessed portions 12E are positioned at the low pressure side by ribs 710~811. In the case where recessed portions 12E are provided, it becomes possible to certainly ensure low pressure receiving areas at the low pressure side as compared with a case where recessed portions 12E are not provided. And therefore, the adhesion effect of seal portions by the pressure difference can be enhanced. Especially when areas of stoppers 712, 812 are large as shown in the embodiment 3-5, areas of recessed portions 12E can be widely secured, and the improvement of the seal integrity can be achieved.

An Embodiment 4-1

Figure 35:
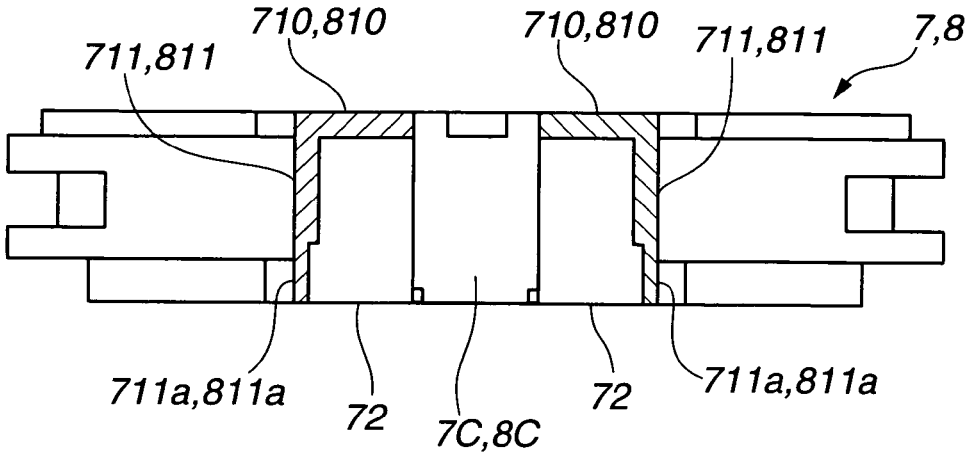
FIG. 35 is a front view, viewed from radial direction, showing a side plate of an embodiment 4-1.
Figure 37:
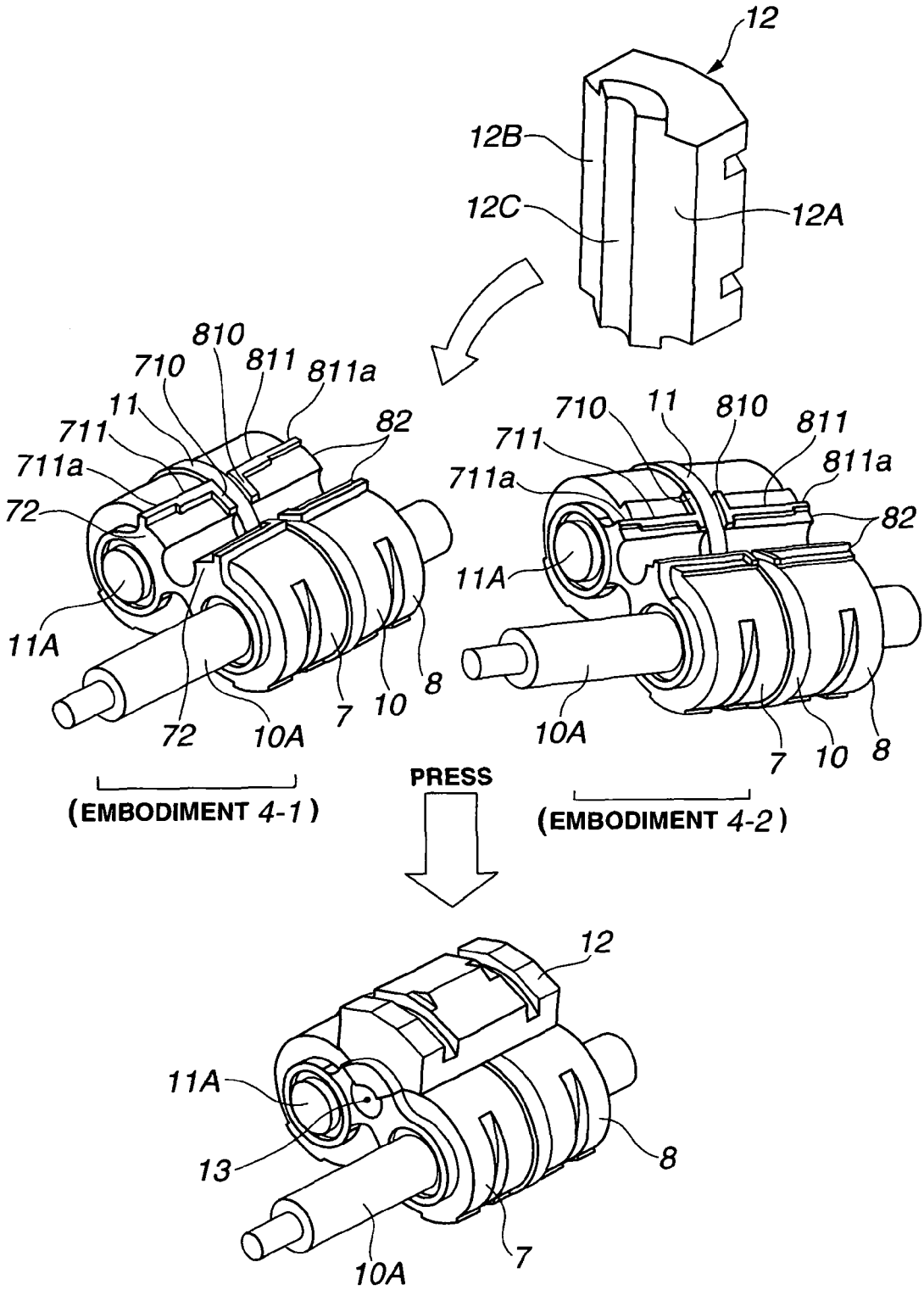
FIG. 37 is a perspective view showing a state in which the seal block is installed on a sub-assembly in the embodiment 4.

FIG. 35 is a front view, viewed from radial direction, of an example in which thicknesses in the radial direction of ribs 711*a* and 811*a* of L-shaped ribs 710~811, where seal block 12 is close to fringe portions 72, 82 of side plates 7, 8, are formed thinner than other portions. FIG. 37 is a diagram showing a production process of the embodiment 4-1 and an embodiment 4-2 by the press. As shown in FIG. 37, since portions of seal block 12, where seal block 12 and fringe portions 72, 82 overlap one another in the axial direction, are thin, the portions are apt to be deformed due to stress concentration at the press. Accordingly, ribs 711*a*, 811*a* are formed thin around fringe portions 72, 82, so that ribs 711*a*, 811*a* can be easily plastically deformed. Therefore, the stress concentration is reduced, and the above deformation of seal block 12 can be avoided.

The Embodiment 4-2

Figure 36:
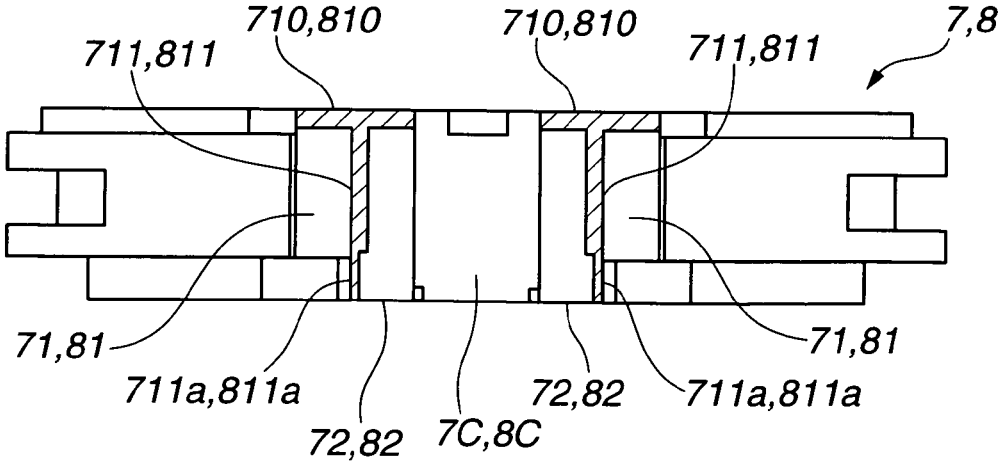
FIG. 36 is a front view, viewed from radial direction, showing a side plate of an embodiment 4-2.

FIG. 36 is an example in which thicknesses in the radial direction of ribs 711*a* and 811*a* of T-shaped ribs 710~811, where seal block 12 is close to fringe portions 72, 82, are formed thin, in the same manner as FIG. 35. Basic effects are similar to that of the embodiment 4-1, their explanations are therefore omitted.

Basic effects of the above embodiments 3-1, 3-2, 3-3, 3-4, 3-5, 3-6, 3-7 are similar to that of the above-mentioned embodiment 3. Their explanations are, therefore, omitted.

Further, technical ideas that is comprehensible from the above embodiments, other than claims, will be described below together with their effects.

(i) The gear pump as claimed in claim 1, wherein, the rib is provided for each of the side plate and seal block, and direction of the rib provided at each member is set to one direction.

Since the direction of the rib is one direction, molding becomes possible by a simple mold. And further it is possible to cut down on costs.

(ii) A method for production of the gear pump as claimed in claim 1, comprising:

a first process for assembling the side plate, the driving and driven gears, and the seal block into a pump assembly; and a second process for plastically deforming the rib by loading between the side plate and seal block.

The load is imposed in the assembled state in which the pump assembly is assembled, and the plastic deformation is made in the final state after assembled. For this reason, it is possible to absorb the variations in accuracy and to improve the seal integrity, in contrast to a case of an assembly from separate parts.

(iii) The gear pump and the method for production of the gear pump as claimed in any one of the claims 1 to 9 and (i) and (ii), wherein, a recessed portion that communicates with the first fluid chamber is formed on an surface of the seal block, on which the side plate abuts.

The low pressure area can be secured between the seal block and the side plate. And therefore the seal integrity between the seal block and the side plate is certainly secured. In the embodiments, the seal block is made from materials such as aluminum that has lower hardness than that of side plate. However, the materials are not limited to this, as long as the ribs can be plastically deformed.

The invention claimed is:

1. A gear pump comprising:

a pump assembly comprising a driving gear supported by a driving shaft, a driven gear supported by a driven shaft, a pair of side plates disposed at both sides in an axial direction of the driving and driven shafts, and a seal block that seals tips of the driving and driven gears and forms a first fluid chamber by installation onto the side plates;

a casing that houses the pump assembly and forms a second fluid chamber therein;

longitudinal and transverse direction ribs provided for at least one member of the side plates or the seal block, and fluid tightness between the first and second fluid chambers being secured by exerting pressure between the side plates and seal block and additionally plastically deforming the ribs.

2. The gear pump as claimed in claim 1, wherein:

thicknesses of portions of the ribs, where the seal block is close to fringe portions of the side plates, are formed to be thinner than other portions of the ribs.

3. The gear pump as claimed in claim 1, wherein the transverse direction ribs comprise transverse direction ribs provided on distal ends of the at least one member of the side plates or the seal block.

4. A gear pump comprising:

a pump assembly comprising a driving gear supported by a driving shaft, a driven gear supported by a driven shaft, a pair of side plates disposed at both sides in an axial direction of the driving and driven shafts, and a seal block that seals tips of the driving and driven gears and forms a first fluid chamber by installation onto the side plates;

a casing that houses the pump assembly and forms a second fluid chamber therein;

a seal ring extending through both sides of a side plate and seal block and supported by being sandwiched between the side plates, seal block and the casing;

longitudinal and transverse direction ribs provided for at least one member of the side plates or the seal block, the ribs being plastically deformed by pressing between the side plates and seal block, and fluid tightness between the first and second fluid chambers being secured by abutment of ends of the ribs.

5. The gear pump as claimed in claim 4, wherein:

thicknesses of portions of the ribs, where the seal block is close to fringe portions of the side plates, are formed to be thinner than other portions of the ribs.

6. The gear pump as claimed in claim 4, wherein:

top surfaces of the ribs are formed substantially in R-shape, and clearance portions are formed continuously with the ribs.

7. A gear pump comprising:

a pump assembly comprising a driving gear supported by a driving shaft, a driven gear supported by a driven shaft, a pair of side plates disposed at both sides in an axial direction of the driving and driven shafts, and a seal block that seals tips of the driving and driven gears and forms a first fluid chamber by installation onto the side plates;

a casing that houses the pump assembly and forms a second fluid chamber therein;

longitudinal and transverse direction ribs provided for at least one member of the side plates or the seal block, the ribs continuously extending in a direction parallel to an axis and in circumferential directions of the driving and driven gears, and fluid tightness between the first and second fluid chambers being secured by pressing between the side plates and seal block and additionally plastically deforming the ribs.

8. The gear pump as claimed in claim 7, wherein:

thicknesses of portions of the ribs, where the seal block is close to fringe portions of the side plates, are formed to be thinner than other portions of the ribs.

9. The gear pump as claimed in claim 7, wherein:

top surfaces of the ribs are formed substantially in R-shape, and clearance portions are formed continuously with the ribs.

10. A gear pump comprising:

a pump assembly comprising a driving gear supported by a driving shaft, a driven gear supported by a driven shaft, a pair of side plates disposed at both sides in an axial direction of the driving and driven shafts, and a seal block that seals tips of the driving and driven gears and forms a first fluid chamber by installation onto the side plates;

a casing that houses the pump assembly and forms a second fluid chamber therein;

longitudinal and transverse direction ribs provided for at least one member of the side plates or the seal block, and fluid tightness between the first and second fluid chambers being secured by plastic deformation of another member of the side plates or the seal block when pressing between the side plates and seal block under a state in which a hardness of the other member is set to be lower than that of the one member.

11. The gear pump as claimed in claim 10, wherein:

thicknesses of portions of the ribs, where the seal block is close to fringe portions of the side plates, are formed to be thinner than other portions of the ribs.

12. The gear pump as claimed in claim 10, wherein:

top surfaces of the ribs are formed substantially in R-shape, and clearance portions are formed continuously with the ribs.

13. A gear pump comprising:

a pump assembly comprising a driving gear supported by a driving shaft, a driven gear supported by a driven shaft, a pair of side plates disposed at both sides in an axial direction of the driving and driven shafts, and a seal block that seals tips of the driving and driven gears and forms a first fluid chamber by installation onto the side plates;

a casing that houses the pump assembly and forms a second fluid chamber therein;

ribs provided for at least one member of the side plates or the seal block, the ribs being plastically deformed by pressing between the side plates and seal block;

stoppers which are lower than tops of the ribs, and are provided together with the ribs, and certain or more spaces being secured between the side plates and seal block by the presence of the stoppers while plastically deforming the ribs by pressing between the side plates and seal block, and fluid tightness between the first and second fluid chambers being secured.

14. The gear pump as claimed in claim 13, wherein:

thicknesses of portions of the ribs, where the seal block is close to fringe portions of the side plates, are formed to be thinner than other portions of the ribs.

15. The gear pump as claimed in claim 13, wherein:

top surfaces of the ribs are formed substantially in R-shape, and clearance portions are formed continuously with the ribs.

16. A gear pump comprising:

a pump assembly comprising a driving gear supported by a driving shaft, a driven gear supported by a driven shaft, a pair of side plates disposed at both sides in an axial direction of the driving and driven shafts, and a seal block that seals tips of the driving and driven gears and forms a first fluid chamber by installation onto the side plates;

a casing that houses the pump assembly and forms a second fluid chamber therein;

ribs provided for at least one member of the side plates or the seal block; and fluid tightness between the first and second fluid chambers being secured by exerting pressure between the side plates and seal block and additionally plastically deforming the ribs;

wherein top surfaces of the ribs are formed substantially in R-shape, and clearance portions are formed continuously with the ribs.

17. A method for producing a gear pump including a pump assembly having a driving gear supported by a driving shaft, a driven gear supported by a driven shaft, a pair of side plates disposed at both sides in an axial direction of the driving and driven shafts, and a seal block that seals tips of the driving and driven gears and forms a first fluid chamber by installation onto the side plates, and a casing that houses the pump assembly and forms a second fluid chamber therein, the method comprising:

providing longitudinal and transverse direction ribs on an installation surface of at least one member of the side plates or the seal block;

plastically deforming the ribs by pressing between the side plates and seal block; and finishing the press at the time when deformation amount of the ribs becomes a predetermined amount and more.

18. A method for producing a gear pump including a pump assembly having a driving gear supported by a driving shaft, a driven gear supported by a driven shaft, pair of side plates disposed at both sides in an axial direction of the driving and driven shafts, and a seal block that seals tips of the driving and driven gears and forms a first fluid chamber by installation onto the side plates, and a casing that houses the pump assembly and forms a second fluid chamber therein, the method comprising:

providing ribs on an installation surface of at least one member of the side plates or the seal block, and additionally stoppers that are lower than tops of the ribs together with the ribs;

plastically deforming the ribs by pressing between the side plates and seal block; and finishing the press at the time when spaces between the side plates and seal block reach positions of the stoppers.

* * * * *